US010783821B2

(12) United States Patent
Xie et al.

(10) Patent No.: US 10,783,821 B2
(45) Date of Patent: Sep. 22, 2020

(54) DISPLAY PANEL, AND METHOD FOR DRIVING THE DISPLAY PANEL

(71) Applicant: XIAMEN TIANMA MICRO-ELECTRONICS CO., LTD., Xiamen (CN)

(72) Inventors: Huimin Xie, Xiamen (CN); Xuexin Lan, Xiamen (CN); Liang Wen, Xiamen (CN); Xiufeng Zhou, Xiamen (CN); Donghua Li, Xiamen (CN); Xiaoxiao Wu, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 152 days.

(21) Appl. No.: 16/017,858

(22) Filed: Jun. 25, 2018

(65) Prior Publication Data

US 2018/0308417 A1 Oct. 25, 2018

(30) Foreign Application Priority Data

Apr. 9, 2018 (CN) ..... 2018 1 0312717

(51) Int. Cl.
*G09G 3/20* (2006.01)
*G09G 3/36* (2006.01)
*G09G 3/3266* (2016.01)

(52) U.S. Cl.
CPC ..... *G09G 3/2096* (2013.01); *G09G 3/3266* (2013.01); *G09G 3/3677* (2013.01); *G09G 2300/0426* (2013.01); *G09G 2310/0202* (2013.01); *G09G 2310/0232* (2013.01); *G09G 2310/0267* (2013.01); *G09G 2310/0281* (2013.01); *G09G 2310/08* (2013.01)

(58) Field of Classification Search
CPC ..... G09G 3/2096; G09G 2300/0426
See application file for complete search history.

(56) References Cited

U.S. PATENT DOCUMENTS

2007/0075954 A1* 4/2007 Oh ..... G09G 3/3258 345/92
2015/0379919 A1* 12/2015 Wen ..... G09G 3/20 345/215
2016/0111040 A1* 4/2016 Kim ..... G02F 1/13454 345/698
2017/0337877 A1* 11/2017 Kim ..... G09G 3/3225
2018/0040291 A1* 2/2018 Wu ..... G09G 5/003
(Continued)

FOREIGN PATENT DOCUMENTS

CN 107123388 A 9/2017
CN 107403605 A 11/2017
(Continued)

*Primary Examiner* — Priyank J Shah
(74) *Attorney, Agent, or Firm* — Alston & Bird LLP

(57) ABSTRACT

The disclosure provides a display panel and a method for driving the display panel. The display panel includes a display area and a peripheral area surrounding the display area, and the display area includes one first display area and at least one second display area. The design according to embodiments of the disclosure release enough space occupied by the peripheral area at one side of the at least one second display area far away from the first display area, thus increasing display area in desired direction and a screen-to-total face ratio.

19 Claims, 23 Drawing Sheets

(56) References Cited

U.S. PATENT DOCUMENTS

| | | | | |
|---|---|---|---|---|
| 2018/0190190 | A1* | 7/2018 | Xi | G09G 3/3208 |
| 2019/0130807 | A1* | 5/2019 | Wu | G09G 3/20 |
| 2019/0251891 | A1* | 8/2019 | Tang | G09G 3/2092 |

FOREIGN PATENT DOCUMENTS

| | | | |
|---|---|---|---|
| CN | 107481669 | A | 12/2017 |
| CN | 107633807 | A | 1/2018 |
| CN | 107634072 | A | 1/2018 |
| EP | 3 163 558 | A1 | 5/2017 |

* cited by examiner

DISPLAY PANEL, AND METHOD FOR DRIVING THE DISPLAY PANEL

CROSS REFERENCE

This application claims the benefit and priority of Chinese Patent Application No. CN201810312717.8 filed Apr. 9, 2018. The entire disclosure of the above application is incorporated herein by reference.

FIELD

The present disclosure relates to the field of display technologies and particularly to a display panel and a method for driving the display panel.

BACKGROUND

Displays generally include liquid crystal displays (LCD) and organic light emitting diode (OLED) displays. A liquid crystal display does not produce light by itself and generally needs a backlight module to provide backlight for displaying, thus limiting the liquid crystal display from being lighter and slimmer. An OLED display is self-emitting, thus does not need a backlight module to provide backlight, so an OLED display is much thinner and lighter than a liquid crystal display. Moreover, the OLED display has characteristics such as high chromaticity, wide viewing angles and quick response time. Therefore, there are good prospects for developing OLED displays.

To meet demands of users, bezels have become narrower, screen-to-body ratios have become higher and weights have become lighter for both liquid crystal displays and OLED displays. However, a narrow border and a large screen-to-body ratio result in small spaces for circuits inside the bezel. Thus, how to arrange the circuits in a narrow bezel effectively has become an urgent problem for those skilled in the art.

SUMMARY

Embodiments of the disclosure provide a display panel and a method for driving the display panel.

An embodiment of the disclosure provides a display panel. The display panel includes a display area and a peripheral area surrounding the display area. The display area includes one first display area and at least one second display area. The first display area includes at least two first scan signal lines arranged along a first direction. Each of the at least two first scan signal lines has a first terminal and a second terminal in the first direction. Each of the at least one second display area includes at least two second scan signal lines arranged along the first direction. Each of the at least two second scan signal lines has a third terminal close to the peripheral area in the first direction. The first display area and the second display area are arranged along the first direction. The peripheral area includes a plurality of cascaded first scan control circuits close to the first and second terminals of the at least two first scan signal lines, and a plurality of cascaded second scan control circuits close to the third terminals of the at least two second scan signal lines. Each of the at least two first scan signal lines is electrically connected to one of the plurality of cascaded first scan control circuits close to the first and second terminals alternately. Each of the at least two second scan signal lines is electrically connected to one of the plurality of cascaded second scan control circuits.

In another aspect, an embodiment of the invention further provides a method for driving a display panel according to any one of the abovementioned embodiments of the disclosure. The method includes: receiving, by the first scan signal lines, scan signals output at the first scan control circuits close to the first terminals and second terminals of the first scan signal lines, alternately; and receiving, by the second scan signal lines, scan signals output by the second scan control circuits close to the third terminals of the second scan signal lines.

DETAILED DESCRIPTION OF THE EMBODIMENTS

Specific embodiments of the disclosure are described below in details with reference to the drawings. It is noteworthy that the described embodiments are only a part of the embodiments of the disclosure, not all of the embodiments of the disclosure. Based upon the embodiments described herein, any other embodiment obtained by those ordinary skilled in the art without making creative efforts pertains to the protection scope of the disclosure.

Figure 1:
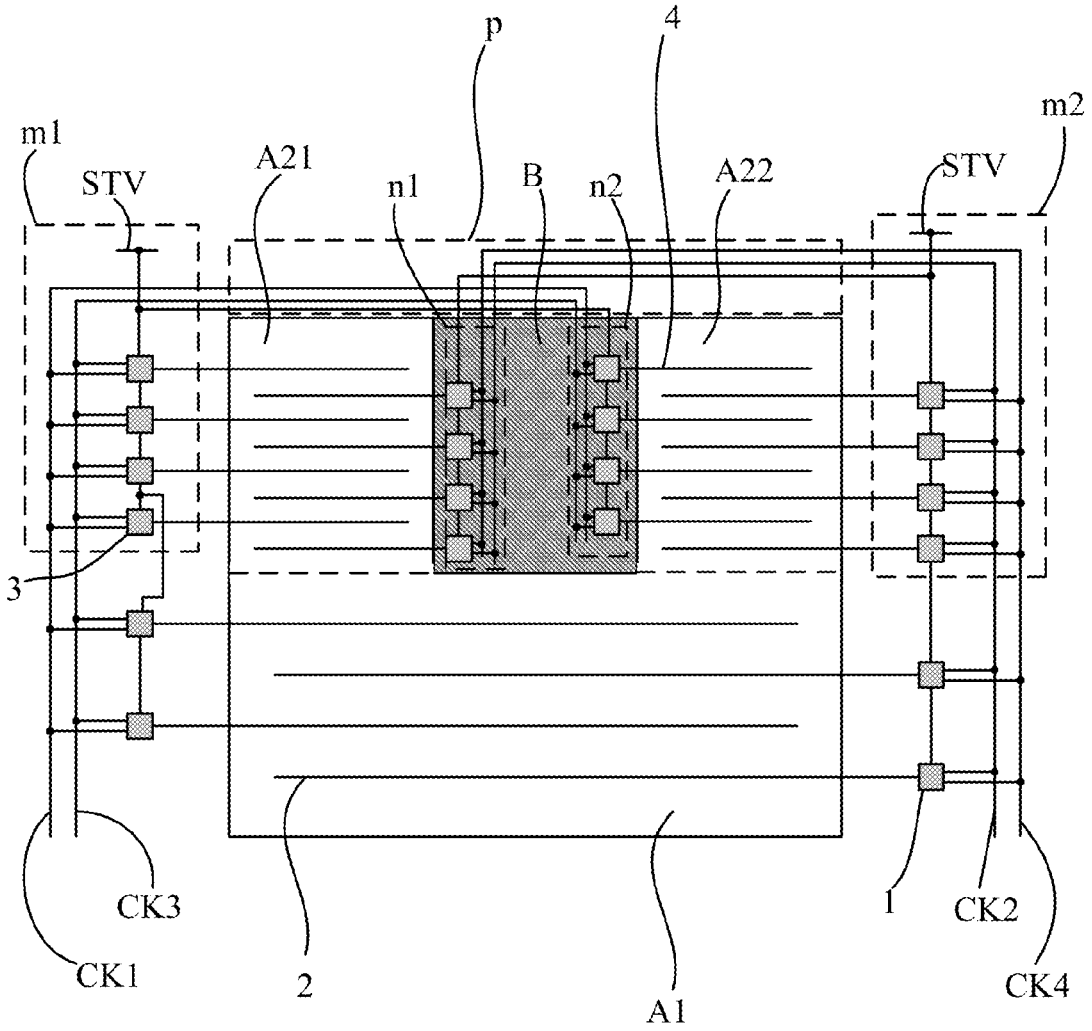
Fig. 1 (RELATED ART)
FIG. 1 is a structural schematic diagram of a conventional display panel.

A structure of a conventional display panel found by the inventor during research is illustrated by FIG. 1. The display panel includes a first display area (denoted by A1), two second display areas (denoted by A21 and A22), and a spacing area (denoted by B). The spacing area B locates between the two second display areas. First scan control circuits 1 are arranged at two opposite sides of the first display area A1, first scan signal lines 2 are arranged in the first display area A1, and the first scan signal lines 2 are electrically connected to the first scan control circuits 1 arranged at the two opposite sides of the first display area A1 alternatively. Second scan control circuits 3 are arranged at two opposite sides of each second display area, second scan signal lines 4 are arranged in each second display area, and the second scan signal lines 4 in each second display area are electrically connected to the second scan control circuits 3 arranged at the two opposite sides of the second display area alternatively. An area on one side of A21 which is far away from the spacing area B is denoted by m1, an area on one side of A21 which is close to the spacing area B is denoted by n1, an area on one side of A22 which is far away from the spacing area B is denoted by m2, and an area on one side of A22 which is close to the spacing area B is denoted by n2.

In one embodiment, to make the second scan signal lines 4 in the two second display areas scan synchronously, clock signal lines and a start signal line in the area m1 need to extend to the area n2, whereas clock signal lines and a start signal line in the area m2 need to extend to the area n1. Therefore, a plurality of connection lines are arranged in the spacing area B and in peripheral areas of the second display areas which are far away from the first display area A1, making the wiring complex and connection lines easily short-circuited, and causing abnormal operation of the circuit. Moreover, since the peripheral areas of the second display areas, which are far away from the first display area A1, and the spacing area are occupied, a border area p of the display panel is widened (e.g., wider than 1 mm), which goes against the narrow bezel design.

In view of this challenge, an embodiment of the disclosure provides a display panel, not only to narrow the wide border area p of the display panel, but also to simplify the wiring and avoid short-circuiting caused by the complex wiring.

Display panels according to embodiments of the disclosure are illustrated by FIGS. 2 to 8. Since each of the display panels illustrated by FIGS. 2 and 3 has only one second display area, A2 denotes the second display area. Whereas each of the display panels illustrated by FIGS. 4 to 8 has two second display areas, so A21 and A22 denote the two second display areas, respectively. A display panel according to an embodiment of the disclosure can include a display area and a peripheral area surrounding the display area. The display area includes a first display area A1 and at least one second display area (when the display area includes only one second display area, the only one second display area is denoted by A2, or when the display area includes two second display areas, the two second display areas are denoted by A21 and A22, respectively).

The first display area A1 can include first scan signal lines S1 arranged along a first direction. Each of the first scan signal lines S1 has a first terminal a and second terminal b in the line direction.

Each of the at least one second display area (A2, A21 or A22) can include second scan signal lines S2 arranged along the first direction. Each of the second scan signal lines S2 has a third terminal c close to the peripheral area in its line direction. The first direction is an arrangement direction of the first display area A1 and the at least one second display area (A2, A21 or A22).

The peripheral area can further include cascaded first scan control circuits V1 arranged near the first terminals a and the second terminals b of the first scan signal lines S1, respectively, and cascaded second scan control circuits V2 arranged near the third terminals c of the second scan signal lines S2.

The first scan signal lines S1 are electrically connected to the first scan control circuits V1 arranged near the first terminals a and near the second terminals b alternately and correspondingly. The second scan signal lines S2 are electrically connected to the second scan control circuits V2 correspondingly.

The display panel according to the embodiment of the disclosure can avoid complex circuit structure and complex wiring. It can also release space of the peripheral area which is on one side of the at least one second display area (A2, A21 or A22) farthest away from the first display area A1 effectively, thus increasing area of the display area in the arrangement direction of the first display area A1 and the at least one second display area (A2, A21 or A22), increasing the screen-to-body ratio and promoting user experience.

In a specific implementation, a structure of a first scan control circuit V1 can be different from that of a second scan control circuit V2, in which case different masks or a mask having a complex pattern (which means that patterns used to fabricate the first scan control circuit V1 and the second scan control circuit V2 in the mask are different) should be used to fabricate the first scan control circuit V1 and the second scan control circuit V2, increasing fabrication difficulty. Therefore, according to the above-mentioned embodiments of the disclosure, structures of the first scan control circuits V1 are generally the same as structures of the second scan control circuits V2. That is, one mask can be used to fabricate the first scan control circuits V1 and the second scan control circuits V2, or a mask with a simple pattern (which means that the patterns used to fabricate the first scan control circuits V1 and the second scan control circuits V2 in the mask are the same) can be used to fabricate the first scan control circuits V1 and the second scan control circuits V2 simultaneously, thereby simplifying the fabrication process and making fabrication easier. It is noteworthy that, as an example, according to each of the embodiments of the disclosure described herein, the first scan control circuits V1 and the second scan control circuits V2 share the same structure.

It is noteworthy that the disclosure is illustrated mainly by taking an example that the display area has two second display areas, so one of the second display areas is denoted as A21 and the other second display area is denoted as A22 in order to illustrate the structure of the display panel according to embodiments of the disclosure clearly. The second scan signal lines located in the second display areas (A21 are A22) are denoted as S2, but in order to distinguish between the two second display areas scan modes of the second scan signal lines as well as connections of each second scan signal line and each second scan control circuit V2, the second scan signal lines in the area A21 are denoted from top to bottom as L21, L22, L23 and etc., and the second scan signal lines in the area A22 are denoted from top to bottom as R21, R22, R23 and etc.

In some embodiments of the disclosure, as shown by FIGS. 2 to 8, the peripheral area can include a spacing area B. The spacing area B and the at least one second display area (A2, A21 or A22) are located on a same side of the first display area A1. The peripheral area can further include a first peripheral area z1 and a second peripheral area z2 located on two opposite sides of the first display area A1, respectively, and at least one third peripheral area z3 on one side of the at least one second display area (A2, A21 or A22) far away from the spacing area B.

Figure 2:
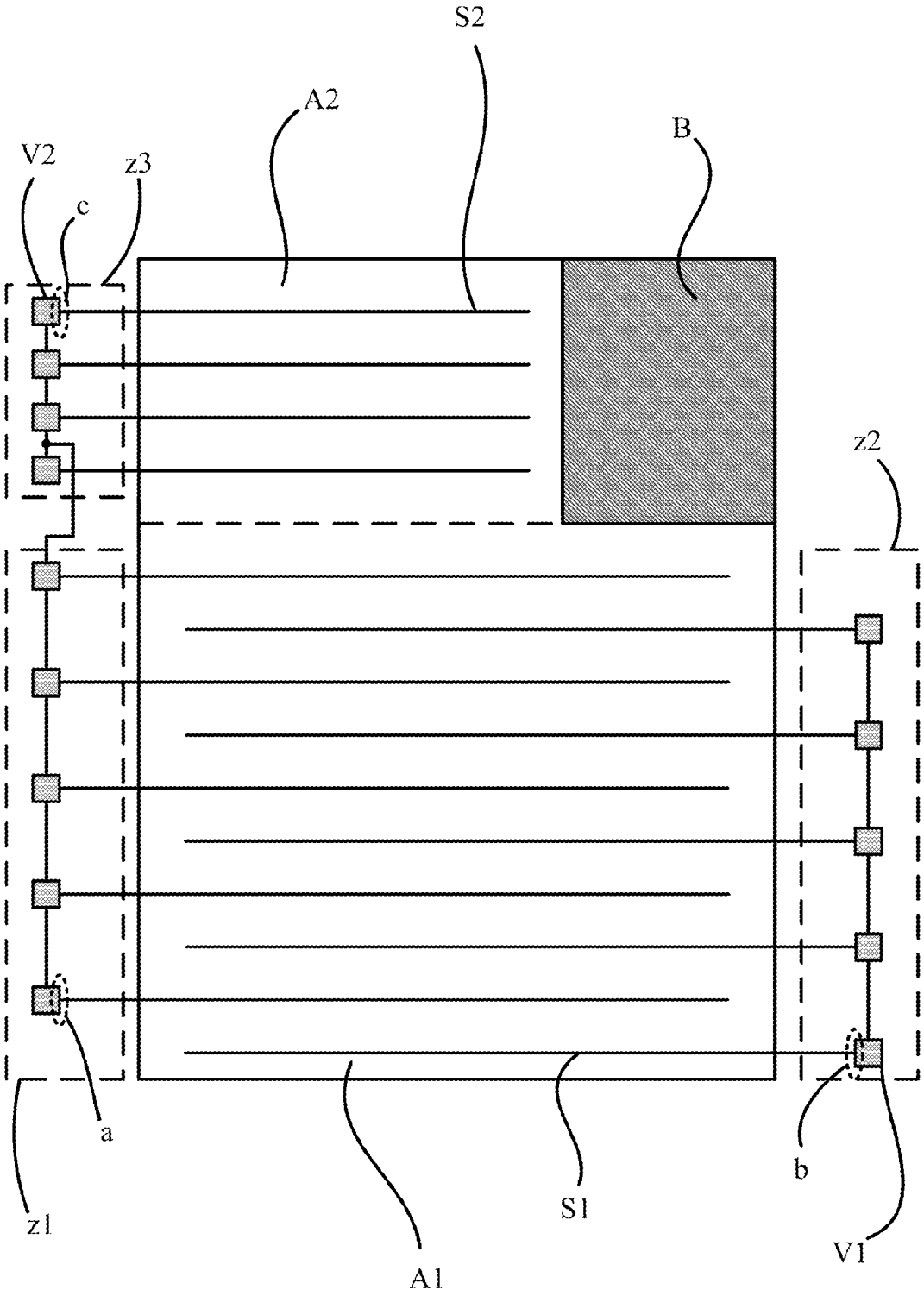
FIGS. 2-3 are structural schematic diagrams of display panels having one display area according to some embodiments of the disclosure.
Figure 3:
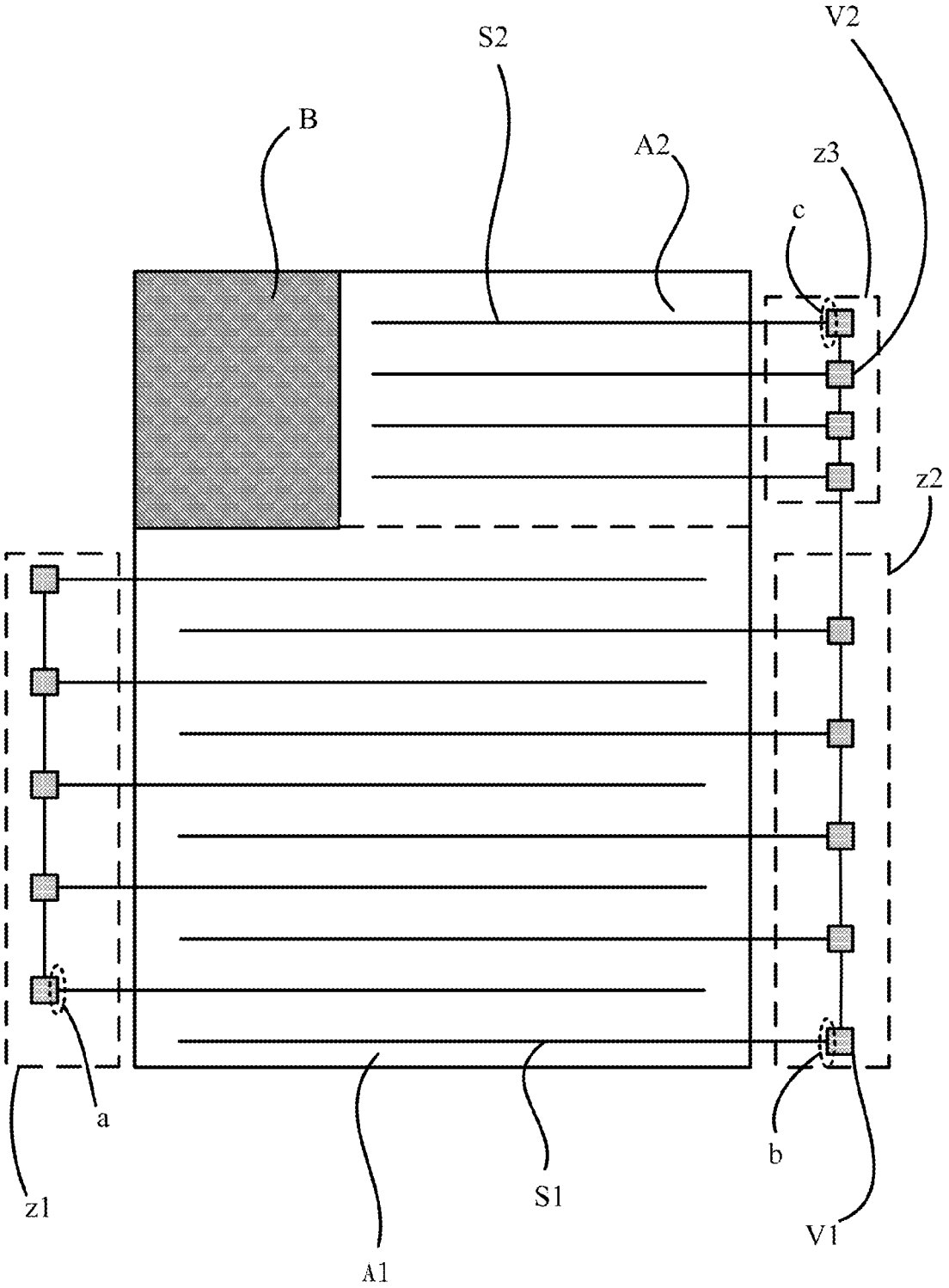

In some embodiments, the display area can include one second display area (such as A2), as illustrated by FIGS. 2 and 3, where no clock signal line is shown. The third peripheral area z3 and the first peripheral area z1 are located on a same side of the display area (as illustrated by FIG. 2), or the third peripheral area z3 and the second peripheral area z2 are located on a same side of the display area (as illustrated by FIG. 3), and in either of the cases, the spacing area B must be at a corner of the display area, and thus the user might not have a satisfactory user experience when the user is viewing an image displayed by the display panel. Thus, to avoid spoiling user experience, in a display panel according to an embodiment of the disclosure, the display area can have one first display area A1 and two second display areas, where the two second display areas are denoted by A21 and A22, respectively. The spacing area B is in the middle between the two second display areas. One third peripheral area z3 and the first peripheral area z1 are on a same side of the display area. The other third peripheral area z3 and the second peripheral area z2 are on a same side of the display area. The first scan control circuits V1 are arranged in the first peripheral area z1 and in the second peripheral area z2, respectively, and the second scan control circuits V2 are arranged in the third peripheral areas z3.

It is taken an example below that the display area includes two second display areas to illustrate the structures of display panels according to some embodiments of the disclosure.

In an embodiment, to enable the first scan control circuits V1 to input scan signals to the first scan signal lines S1 and to enable the second scan control circuits V2 to input the scan signals to the second scan signal lines S2, as illustrated by FIGS. 4 to 8, the peripheral area can further include a first group of clock signal lines 10 and a second group of clock signal lines 20. The first group of clock signal lines 10 are electrically connected to the first scan control circuits V1 and the second scan control circuits V2 on one side of the display area, respectively. The second group of clock signal lines 20 are electrically connected to the first scan control circuits V1 and the second scan control circuits V2 on the other side of the display area, respectively. As such, under the control of clock signals input by the first group of clock signal lines 10 and by the second group of clock signal lines 20, the first scan control circuits V1 can input scan signals to the first scan signal lines S1 and the second scan control circuits V2 can input the scan signals to the second scan signal lines S2, facilitating implementation of the display function of the display panel.

Of course, in an embodiment of the disclosure, the first scan control circuits V1 within the first peripheral area z1 and within the second peripheral area z2 can alternatively input the scan signals to electrically connected first scan signal lines S1 under the control of the first group of clock signal lines 10 and of the second group of clock signal lines 20. That is, the first scan control circuits V1 on the opposite sides of the first display area A1 are driven in an interlaced mode, so that the first scan signal lines S1 in the first display area A1 are scanned successively. For the second display areas, the number of clock signal lines included in each group of clock signal lines, and connections of each group of clock signal lines with the first scan control circuits V1 and with the second scan control circuits V2 can be set according to a scan mode to be implemented.

In an embodiment, for the second display areas, the second scan control circuits V2 in the third peripheral areas z3 input scan signals to electrically connected second scan signal lines S2 under the control of the first group of clock signal lines 10 or of the second group of clock signal lines 20, so that the second scan signal lines S2 in each of the second display areas are scanned successively, and second scan signal lines S2 at a same stage in the two second display areas are scanned synchronously or alternately.

In several implementation modes below, the second scan signal lines S2 in each of the second display areas can be scanned successively, and second scan signal lines S2 at a same stage in the two second display areas can be scanned synchronously.

Figure 4:
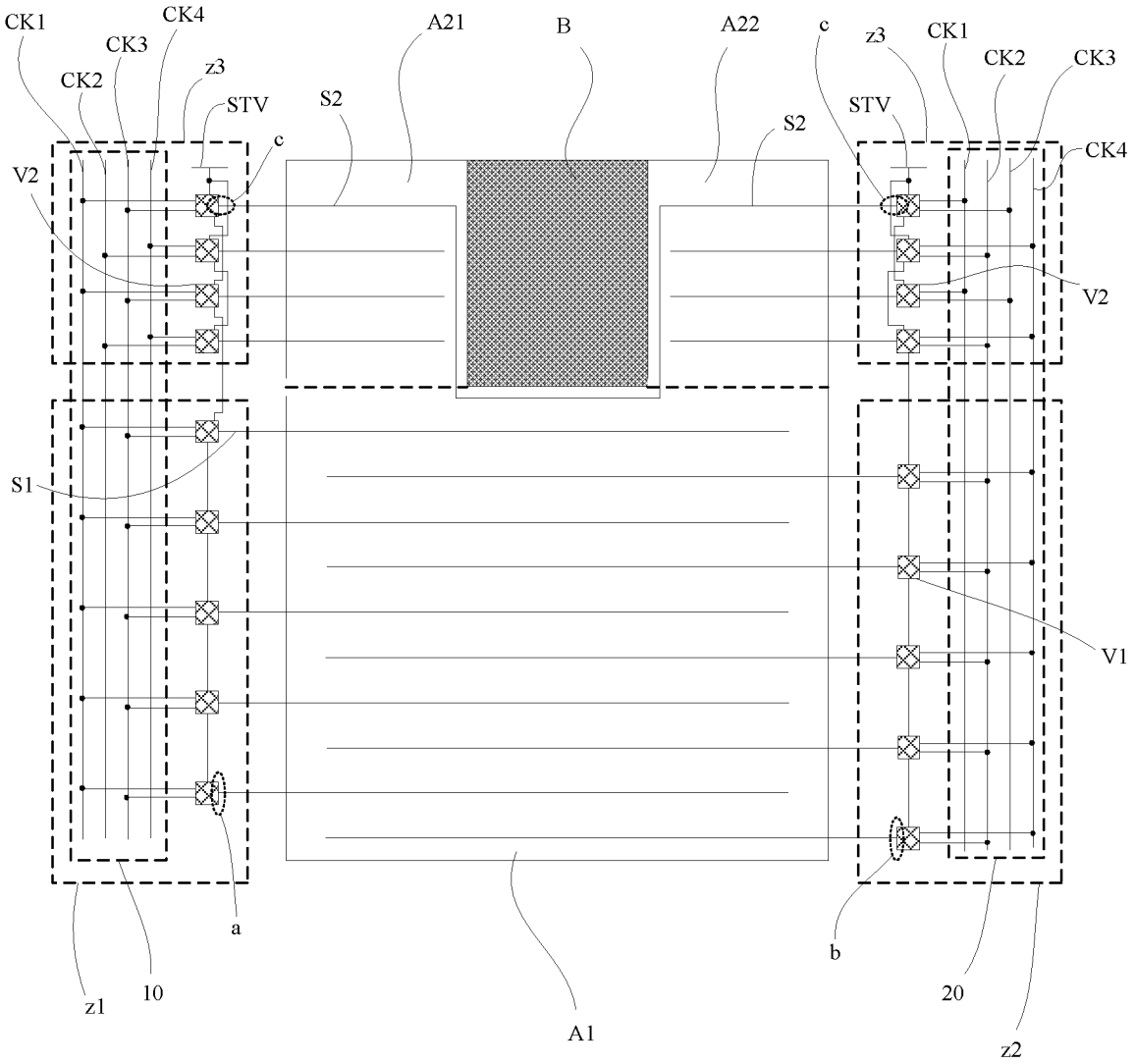
FIGS. 4-5 are structural schematic diagrams of display panels having two display areas according to some embodiments of the disclosure.
Figure 5:
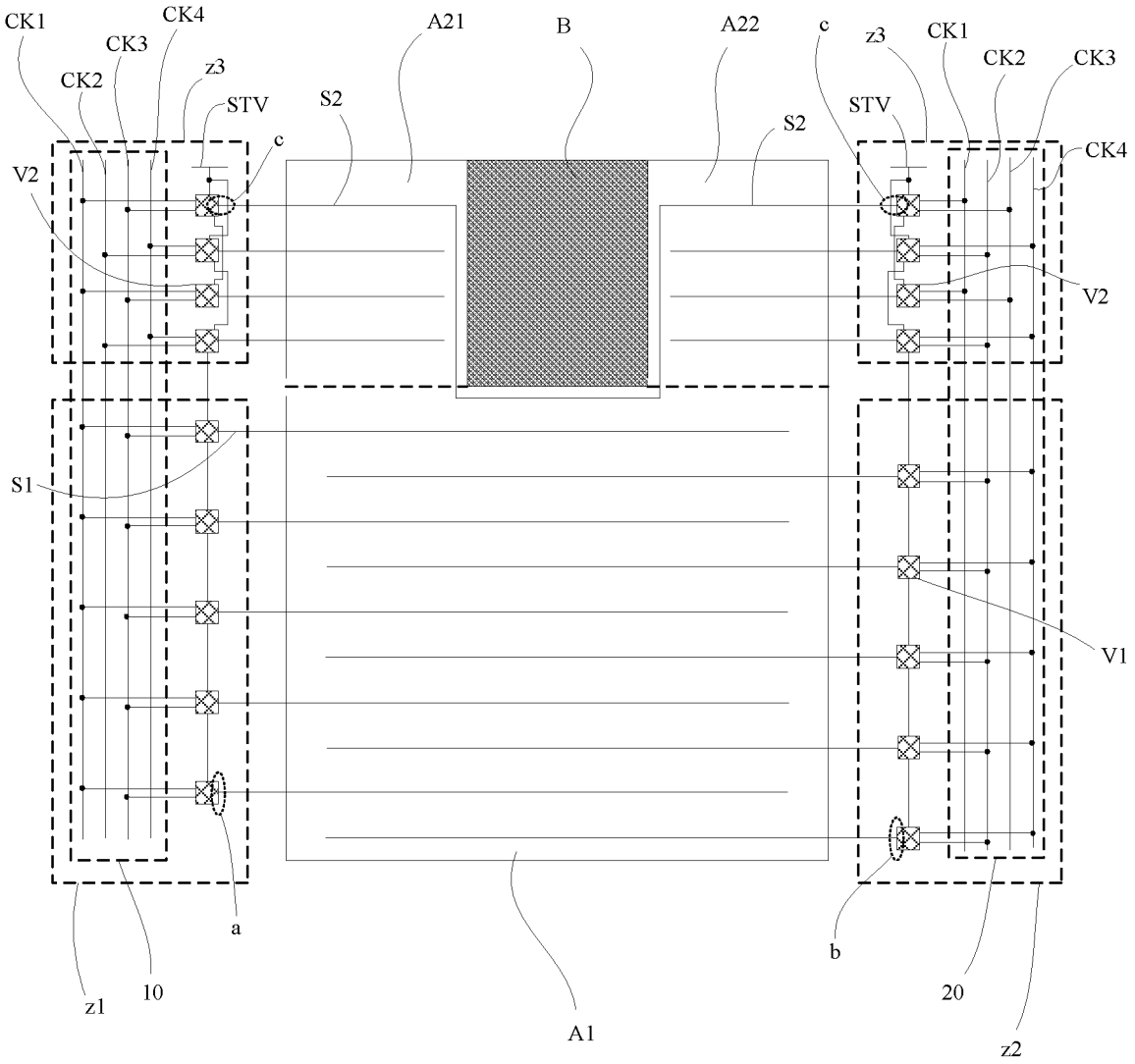

In one implementation mode, as illustrated by FIGS. 4 and 5, when a second scan signal line S2 is electrically connected to a second scan control circuit V2, each of the first and second groups of clock signal lines 10 can include a first clock signal line CK1 to a fourth clock signal line CK4. That is, four clock signal lines are arranged on either of two opposite sides of the display area to provide clock signals to all the scan control circuits arranged on the two opposite sides of the display area. Moreover, in an embodiment of the disclosure, the first clock signal line CK1 to the fourth clock signal line CK4 input the clock signals successively.

In an embodiment, as illustrated by FIGS. 4 and 5, when each of the first and second groups of clock signal lines 10 includes the first clock signal line CK1 to the fourth clock signal line CK4, the connections of each group of clock signal lines with the first scan control circuits V1 and with the second scan control circuits V2 are as follows.

On one side of the display area, first scan control circuits V1 are electrically connected to the first clock signal line CK1 and the third clock signal line CK3 in the first group of clock signal lines 10, respectively. In every two adjacent second scan control circuits V2, one second scan control circuit V2 is electrically connected to the first clock signal line CK1 and the third clock signal line CK3 in the first group of clock signal lines 10, and the other second scan control circuit V2 is electrically connected to the second clock signal line CK2 and the fourth clock signal line CK4 in the first group of clock signal lines 10. On the other side of the display area, first scan control circuits V1 are electrically connected to the second clock signal line CK2 and the fourth clock signal line CK4 in the second group of clock signal lines 20, respectively. In every two adjacent second scan control circuits V2, one second scan control circuit V2 is electrically connected to the first clock signal line CK1 and the third clock signal line CK3 in the second group of clock signal lines 20, and the other second scan control circuit V2 is electrically connected to the second clock signal line CK2 and the fourth clock signal line CK4 in the second group of clock signal lines 20.

In brief, on one side of the display area, a second scan control circuit V2 at an odd stage is electrically connected to clock signal lines at odd stages of the first group of clock signal lines 10, and a second scan control circuit V2 at an even stage is electrically connected to clock signal lines at even stages of the first group of clock signal lines 10. On the other side of the display area, a second scan control circuit V2 at an odd stage is electrically connected to clock signal lines at odd stages of the second group of clock signal lines 20, and a second scan control circuit V2 at an even stage is electrically connected to clock signal lines at even stages of the second group of clock signal lines 20.

For example, as illustrated by FIGS. 4 and 5, if the four second scan control circuits V2 on the left side of the left second display area (A21) are denoted by V21, V22, V23 and V24 successively from top to bottom, each of V21 and V23 is electrically connected to the first clock signal line CK1 and the third clock signal line CK3 in the first group of clock signal lines 10, and each of V22 and V24 is electrically connected to the second clock signal line CK2 and the fourth clock signal line CK4 in the first group of clock signal lines 10. Similarly, connections of the four second scan control circuits V2 on the right side of the right second display area with the second group of clock signal lines 20 are arranged in the same way as those on the left side, and repeated descriptions thereof are omitted herein.

Moreover, in the structures illustrated by FIGS. 4 and 5, the second scan signal lines S2 in each second display area are scanned successively, and every pair of second scan signal lines S2 at each stage in the two second display areas are scanned synchronously. For example, if the second scan signal lines S2 in the left second display area are denoted by L21, L22, L23 and L24 successively from top to bottom, and the second scan signal lines S2 in the right second display area are denoted by R21, R22, R23 and R24 successively from top to bottom, L21 and R21 input scan signals synchronously, L22 and R22 input scan signals synchronously, L23 and R23 input scan signals synchronously, and L24 and R24 input scan signals synchronously. However, the second scan control circuits V2 in two third peripheral areas z3 input scan signals to the second scan signal lines S2 in the two second display areas under the action of the first group of clock signal lines 10 or of the second group of clock signal lines 20, and this arrangement may cause signal errors resulting in image infidelity. In addition, uniformity of image may show up. Therefore, in some embodiments of the disclosure, as illustrated by FIGS. 4 and 5, second scan signal lines S2 farthest away from the first display area A1 in the two second display areas can be electrically connected to eliminate the display unevenness of the two second display areas.

In addition, in an embodiment of the disclosure, connections of the cascaded first scan control circuits V1 and connections of the cascaded second scan control circuits V2 are as follows.

The peripheral area can further include start signal lines on two opposite sides of the display area. The start signal lines are configured to provide start signals to second scan control circuits at a first stage and at a second stage, respectively. That is, the start signal lines provide the start signals to the signal input terminals (STVs) of the second scan control circuits at the first stage and at the second stage, respectively. First signal output terminals of second scan control circuits at each stage are electrically connected to corresponding second scan signal lines. First signal output terminals of first scan control circuits at each stage are electrically connected to corresponding first scan signal lines. Except second scan control circuits at last two stages, second signal output terminals of second scan control circuits at each odd stage are electrically connected to signal input terminals of second scan control circuit at next odd stage, and second signal output terminals of second scan control circuits at each even stage are electrically connected to signal input terminals of second scan control circuits at next even stage. Except first scan control circuits at the last stage, second signal output terminals of first scan control circuits at each stage are electrically connected to signal input terminals of first scan control circuits at next stage.

On one side of the display area, a second signal output terminal of a second scan control circuit at the last odd stage is electrically connected to the signal input terminal of the first scan control circuit at the first stage, and on the other side of the display area, a second signal output terminal of a second scan control circuit at the last even stage is electrically connected to the signal input terminal of the first scan control circuit at the first stage (as illustrated by FIG. 4). Or, on one side of the display area, a second signal output terminal of a second scan control circuit at the last stage is electrically connected to the signal input terminal of the first scan control circuit at the first stage; and on the other side of the display area, a second signal output terminal of a second scan control circuit at the last stage is electrically connected to the signal input terminal of the first scan control circuit at the first stage (as illustrated by FIG. 5).

That is, the difference between the structures illustrated by FIGS. 4 and 5 is how the second scan control circuits provide effective pulse signals to the first scan control circuits. In the structure illustrated by FIG. 4, the first scan control circuits are controlled by the time sequence of the effective pulse signals provided by the second scan control circuits, so that the first scan signal lines can be scanned successively. Whereas in the structure illustrated by FIG. 5, the first scan control circuits are controlled by the time sequence of the clock signals, so that the first scan signal lines can be scanned successively. In both kinds of structures, every pair of second scan signal lines at each stage in the two second display areas can be scanned synchronously, and the first scan signal lines in the first display area can be scanned successively, thereby achieving the desired display function.

For example, in the structure illustrated by FIG. 4, if the four second scan control circuits V2 on the left side of the left second display area (A21) are denoted by V21, V22, V23 and V24 from top to bottom, and the second scan signal lines S2 in the left second display area (A21) are denoted by L21, L22, L23 and L24 from top to bottom, the first signal output terminal of V21 is electrically connected to L21, the second signal output terminal of V21 is electrically connected to the signal input terminal of V23, the first signal output terminal of V22 is electrically connected to L22 and the second signal output terminal of V22 is electrically connected to the signal input terminal of V24. Connections of the cascaded second scan control circuits V2 on the right side of the right second display area (A22) are arranged in the same way as those on the left side, and a repeated description thereof is omitted herein.

If the first scan control circuits V1 on the left side of the first display area A1 are denoted by V11, V12, V13, V14 and V15 from top to bottom, and the first scan signal lines S1 in the first display area A1 are denoted by S11, S12, S13, S14, S15, S16, S17, S18, S19 and S110 from top to bottom, the first signal output terminal of V11 is electrically connected to S11, the second signal output terminal of V11 is electrically connected to the signal input terminal of V12, the first signal output terminal of V12 is electrically connected to S13, the second signal output terminal of V12 is electrically connected to the signal input terminal of V13, the first signal output terminal of V13 is electrically connected to S15, the second signal output terminal of V13 is electrically connected to the signal input terminal of V14, the first signal output terminal of V14 is electrically connected to S17, the second signal output terminal of V14 is electrically connected to the signal input terminal of V15, and the first signal output terminal of V15 is electrically connected to S19.

In an embodiment, the structures of the first and second scan control circuits can be different. Of course, to reduce fabrication difficulty, the structures of the first and second scan control circuits can also be the same. That is, as illustrated by FIG. 6, each of the first scan control circuits can include a storage sub-circuit, an NAND gate sub-circuit and an amplification sub-circuit, all connected in series, and each of the second scan control circuits can also include a storage sub-circuit, a negative-AND (NAND) gate sub-circuit and an amplification sub-circuit, all connected in series.

Figure 6:
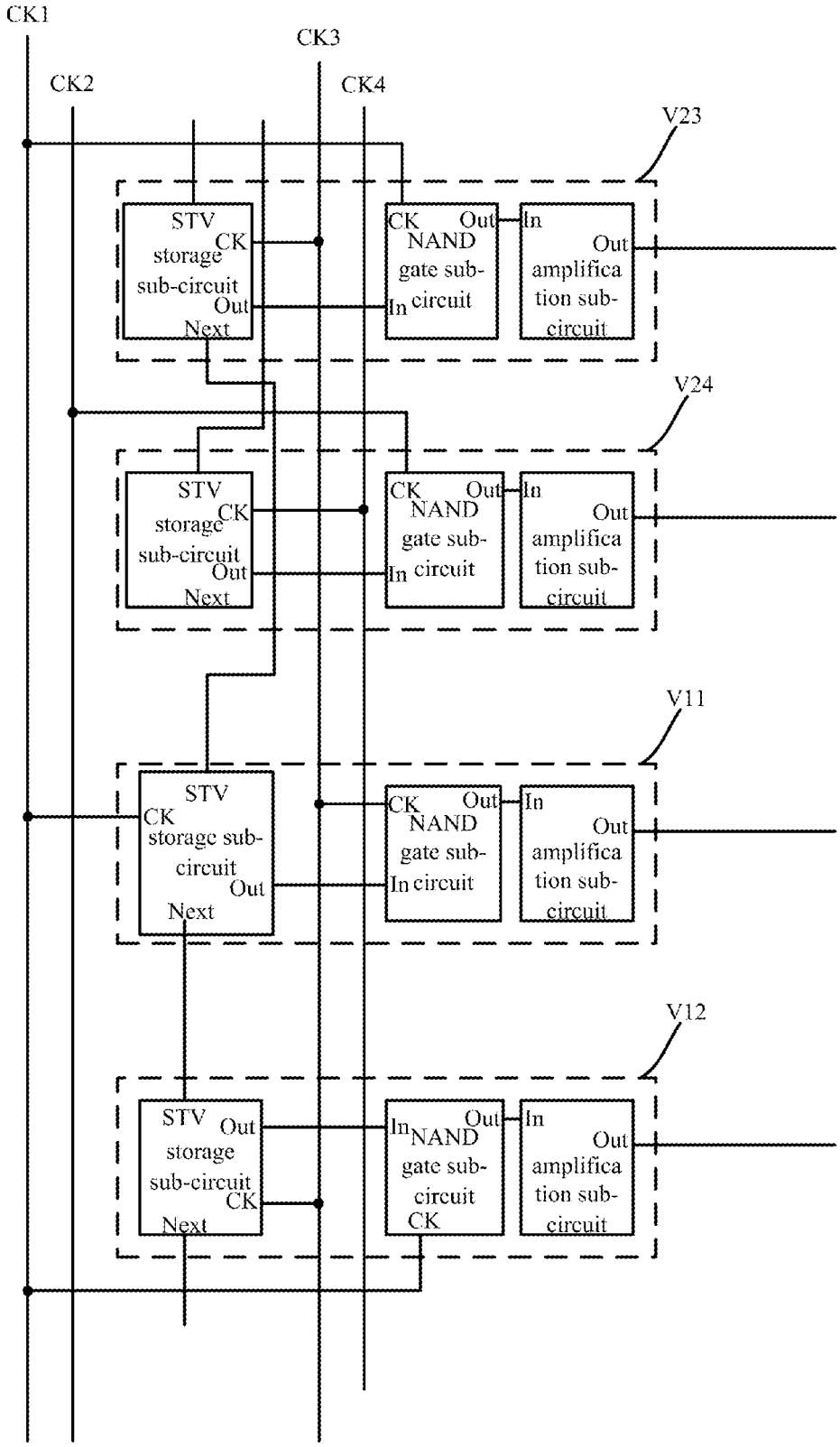
FIG. 6 is a circuit block diagram according to an embodiment of the disclosure.

In the embodiment illustrated by FIG. 6, in two adjacent first scan control circuits, the storage sub-circuit of one first scan control circuit is electrically connected to the first clock signal line in the first group of clock signal lines, and the NAND gate sub-circuit of the first scan control circuit is electrically connected to the third clock signal line in the first group of clock signal lines. The storage sub-circuit of the other first scan control circuit is electrically connected to the third clock signal line in the first group of clock signal lines, and the NAND gate sub-circuit of the other first scan control circuit is electrically connected to the first clock signal line in the first group of clock signal lines.

In two adjacent second scan control circuits, the storage sub-circuit of one second scan control circuit is electrically connected to the first clock signal line in the first group of clock signal lines, and the NAND gate sub-circuit of the second scan control circuit is electrically connected to the third clock signal line in the first group of clock signal lines. The storage sub-circuit of the other second scan control circuit is electrically connected to the second clock signal line in the first group of clock signal lines. The NAND gate sub-circuit of the other second scan control circuit is electrically connected to the fourth clock signal line in the first group of clock signal lines.

For two second scan control circuits separated by another second scan control circuit, when the two second scan control circuits are electrically connected to the first and third clock signal lines in the first group of clock signal lines, respectively, if the storage sub-circuit of one second scan control circuit is electrically connected to the first clock signal line in the first group of clock signal lines and the NAND gate sub-circuit of the second scan control circuit is electrically connected to the third clock signal line in the first group of clock signal lines, then the storage sub-circuit of the other second scan control circuit is electrically connected to the third clock signal line in the first group of clock signal lines, and the NAND gate sub-circuit of the other second scan control circuit is electrically connected to the first clock signal line in the first group of clock signal lines.

It is noteworthy that, when two second scan control circuits separated by another second scan control circuit are electrically connected to the second and fourth clock signal lines in the first group of clock signal lines, respectively, the connections are similar to the abovementioned connections, and a repeated description thereof is omitted here.

Moreover, in the embodiment of the disclosure illustrated by FIG. 6, except the first scan control circuits at the last stage, a storage sub-circuit of a first scan control circuit at each stage inputs an effective pulse signal to a storage sub-circuit of a first scan control circuit at the next stage. And except second scan control circuits at the last two stages, a storage sub-circuit of a second scan control circuit at each odd stage inputs an effective pulse signal to a storage sub-circuit of a second scan control circuit at the next odd stage, and a storage sub-circuit of a second scan control circuit at each even stage inputs an effective pulse signal to a storage sub-circuit of a second scan control circuit at the next even stage.

On one side of the display area, a storage sub-circuit of a second scan control circuit at the last odd stage inputs an effective pulse signal to a storage sub-circuit of a first scan control circuit at the first stage, and on the other side of the display area, a storage sub-circuit of a second scan control circuit at the last even stage inputs an effective pulse signal to a storage sub-circuit of a first scan control circuit at the first stage (as illustrated by FIG. 6). Or, on one side of the display area, a storage sub-circuit of a second scan control circuit at the last stage inputs an effective pulse signal to a storage sub-circuit of a first scan control circuit at the first stage; and on the other side of the display area, a storage sub-circuit of a second scan control circuit at the last stage inputs an effective pulse signal to a storage sub-circuit of a first scan control circuit at the first stage (not illustrated).

The arrangement above ensures that all the first scan signal lines in the first display area are scanned successively and all the second scan signal lines in each of the second display areas are scanned successively, so that the entire display area can display images normally.

The first scan control circuits V11 and V12 and the second scan control circuits V23 and V24 are illustrated by FIG. 6. Assuming that V23 and V24 are the second scan control circuits at the last two stages on the left side of the left second display area (A21) illustrated by FIG. 4, for the second scan control circuits V23 and V24, the storage sub-circuit of V23 is electrically connected to the third clock signal line CK3, the NAND gate sub-circuit of V23 is electrically connected to the first clock signal line CK1, the storage sub-circuit of V24 is electrically connected to the fourth clock signal line CK4, the NAND gate sub-circuit of V24 is electrically connected to the second clock signal line CK2, and V23 inputs an effective pulse signal to the signal input terminal STV of V11.

For the first scan control circuits V11 and V12, the storage sub-circuit of V11 is electrically connected to the first clock signal line CK1, the NAND gate sub-circuit of V11 is electrically connected to the third clock signal line CK3, the storage sub-circuit of V12 is electrically connected to the third clock signal line CK3, the NAND gate sub-circuit of V12 is electrically connected to the first clock signal line CK1, and V11 inputs an effective pulse signal to the signal input terminal STV of V12, to ensure that the first and second display areas can implement the display function and display images normally.

The above-mentioned connections of the cascaded scan control circuits can enable the second scan signal lines S2 in each of the second display areas to be scanned successively and the second scan signal lines S2 at the same stage in the two second display areas to be scanned synchronously, via the second scan control circuits V2. Of course, the structures of the storage sub-circuits, NAND gate sub-circuits and amplification sub-circuits of the first scan control circuits V1 and of the second scan control circuits V2 can be any structures known by those skilled in the art.

In the conventional display panel illustrated by FIG. 1, the second scan signal lines S2 in each second display area are scanned successively through arrangement of the second scan control circuits V2 on two opposite sides of the second display area. While as illustrated by FIGS. 4-6, in the embodiments of the disclosure, the second scan signal lines S2 in each second display area are scanned successively when the second scan control circuits V2 are arranged only in the third peripheral areas z3, which can not only release space of the spacing area B effectively to avoid arranging too many signal lines in the upper border area and to facilitate implementation of a narrow bezel design, but also ensure normal scanning without changing the structures of the second scan control circuits V2. Moreover, comparing with the conventional display panel, the embodiments of the disclosure ensure that a pulse width (PW) of clock signals input by each clock signal line to the second scan control circuits V2 remains unchanged, that is, charging time for each row remains unchanged. In addition, the embodiments ensure that the scan frequency of the second display areas is the same as that in the conventional display panel so that the display panel displays images normally.

Figure 7:
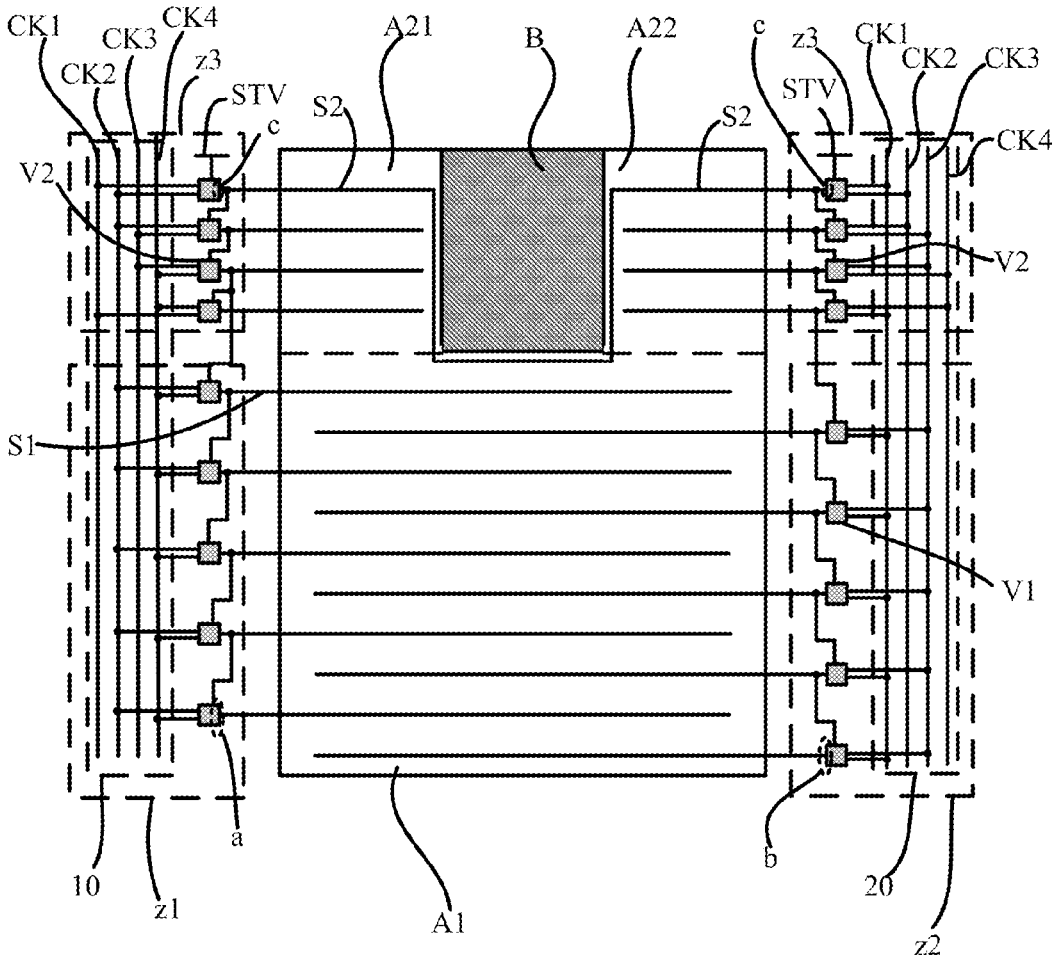
FIGS. 7-8 are structural schematic diagrams of display panels having two display areas according to some embodiments of the disclosure.

In another implementation mode similar to the above-mentioned implementation mode, as illustrated by FIG. 7, when one second scan signal line S2 is electrically connected to one second scan control circuit V2 correspondingly, each of the first group of clock signal lines 10 and the second group of clock signal lines 20 can include a first clock signal line CK1 to a fourth clock signal line CK4. That is, four clock signal lines are arranged at each of two opposite sides of the display area to provide clock signals to all the scan control circuits arranged on the two opposite sides. Moreover, in an embodiment of the disclosure, the first clock signal line CK1 to the fourth clock signal line CK4 input the clock signals successively.

But the difference between this implementation mode and the implementation mode described previously is that connections of each group of clock signal lines with each first scan control circuit V1 and each second scan control circuits V2 are different In an embodiment, as illustrated by FIG. 7, on one side of the display area, the first scan control circuits V1 are electrically connected to the second clock signal line CK2 and fourth clock signal line CK4 in the first group of clock signal lines 10, respectively. The second scan control circuit V2 at a 4n+1 stage is electrically connected to the first clock signal line CK1 and second clock signal line CK2 in the first group of clock signal lines 10, respectively. The second scan control circuit V2 at a 4n+2 stage is electrically connected to the second clock signal line CK2 and third clock signal line CK3 in the first group of clock signal lines 10, respectively. The second scan control circuit V2 at a 4n+3 stage is electrically connected to the third clock signal line CK3 and fourth clock signal line CK4 in the first group of clock signal lines 10, respectively. And the second scan control circuit V2 at a 4n+4 stage is electrically connected to the fourth clock signal line CK4 and first clock signal line CK1 in the first group of clock signal lines 10, respectively. n is an integer not less than 1.

As illustrated by FIG. 7, on another side of the display area, the first scan control circuits V1 are electrically connected to the first clock signal line CK1 and third clock signal line CK3 in the second group of clock signal lines 20, respectively. The second scan control circuit V2 at the 4n+1 stage is electrically connected to the first clock signal line CK1 and second clock signal line CK2 in the second group of clock signal lines 20, respectively. The second scan control circuit V2 at the 4n+2 stage is electrically connected to the second clock signal line CK2 and third clock signal line CK3 in the second group of clock signal lines 20, respectively. The second scan control circuit V2 at the 4n+3 stage is electrically connected to the third clock signal line CK3 and fourth clock signal line CK4 in the second group of clock signal lines 20, respectively. And the second scan control circuit V2 at the 4n+4 stage is electrically connected to the fourth clock signal line CK4 and first clock signal line CK1 in the second group of clock signal lines 20, respectively. For example, as illustrated by FIG. 7, if four second scan control circuits V2 on the left side of the left second display area (A21) are denoted by V21, V22, V23 and V24 successively from top to bottom, V21 is electrically connected to the first clock signal line CK1 and the second clock signal line CK2 in the first group of clock signal lines 10, V22 is electrically connected to the second clock signal line CK2 and the third clock signal line CK3 in the first group of clock signal lines 10, V23 is electrically connected to the third clock signal line CK3 and the fourth clock signal line CK4 in the first group of clock signal lines 10, and V24 is electrically connected to the fourth clock signal line CK4 and the first clock signal line CK1 in the first group of clock signal lines 10. The connections of the four second scan control circuits V2 on the right side of the right second display area with the second group of clock signal lines 20 are arranged in the same way as those on the left side, and a repeated description thereof is omitted herein.

Moreover, in the structure illustrated by FIG. 7, the second scan signal lines S2 in each second display area are scanned successively, and the second scan signal lines S2 in the two second display areas are scanned synchronously. However, since the second scan control circuits V2 in the two third peripheral areas z3 input scan signals to the second scan signal lines S2 in the two second display areas under the action of the first group of clock signal lines 10 or of the second group of clock signal lines 20, this arrangement may cause signal errors resulting in image infidelity. In addition, uniformity of image may show up. Therefore, in an embodiment of the disclosure, as illustrated by FIG. 7, second scan signal lines S2 farthest away from the first display area A1 in the two second display areas can be electrically connected to eliminate the display unevenness of the two second display areas.

In addition, in an embodiment of the disclosure, connections of the cascaded first scan control circuits V1 and connections of the cascaded second scan control circuits V2 are as follows.

The peripheral area can further include start signal lines on two opposite sides of the display area. The start signal lines are configured to provide start signals to second scan control circuits at a first stage. That is, the start signal lines are configured to provide the start signals to the STVs of the second scan control circuits at the first stage. Signal output terminals of second scan control circuits at each stage are electrically connected to corresponding second scan signal lines. Signal output terminals of first scan control circuits at each stage are electrically connected to corresponding first scan signal lines. Except second scan control circuits at the last stage, signal output terminals of second scan control circuits at each odd stage are electrically connected to signal input terminals of second scan control circuit at next stage. Except first scan control circuits at the last stage, signal output terminals of first scan control circuits at each stage are electrically connected to signal input terminals of first scan control circuits at next stage.

On one side of the display area, a signal output terminal of a second scan control circuit at the last stage is electrically connected to the signal input terminal of the first scan control circuit at the first stage, and on the other side of the display area, a signal output terminal of a second scan control circuit at the second last stage is electrically connected to the signal input terminal of the first scan control circuit at the first stage (as illustrated by FIG. 7). Or, on one side of the display area, a signal output terminal of a second scan control circuit at the last stage is electrically connected to the signal input terminal of the first scan control circuit at the first stage; and on the other side of the display area, a signal output terminal of a second scan control circuit at the last stage is electrically connected to the signal input terminal of the first scan control circuit at the first stage (not illustrated).

That is, the difference between the above-mentioned two kinds of connections is how the second scan control circuits provide effective pulse signals to the first scan control circuits. In the first kind of connections illustrated by FIG. 7, the first scan control circuits are controlled by the time sequence of the effective pulse signals provided by the second scan control circuits, so that the first scan signal lines can be scanned successively. Whereas in the second kind of connections (not illustrated), the first scan control circuits are controlled by the time sequence of the clock signals, so that the first scan signal lines can be scanned successively. With both kinds of connections, every pair of second scan signal lines at each stage in the two second display areas can be scanned synchronously, and the first scan signal lines in the first display area can be scanned successively, thereby achieving the desired display function.

For example, in the structure illustrated by FIG. 7, if the four second scan control circuits V2 on the left side of the left second display area (A21) are denoted by V21, V22, V23 and V24 from top to bottom, and the second scan signal lines S2 in the left second display area (A21) are denoted by L21, L22, L23 and L24 from top to bottom, the signal output terminal of V21 is electrically connected to L21, the signal output terminal of V21 is electrically connected to the signal input terminal of V22. The signal output terminal of V22 is electrically connected to L22 and the signal output terminal of V22 is electrically connected to the signal input terminal of V23. The signal output terminal of V23 is electrically connected to L23 and the signal output terminal of V23 is electrically connected to the signal input terminal of V24. The signal output terminal of V24 is electrically connected to L24. Connections of the cascaded second scan control circuits V2 on the right side of the right second display area (A22) are arranged in the same way as those on the left side, and a repeated description thereof is omitted herein.

If the first scan control circuits V1 on the left side of the first display area A1 are denoted by V11, V12, V13, V14 and V15 from top to bottom, and the first scan signal lines S1 in the first display area A1 are denoted by S11, S12, S13, S14, S15, S16, S17, S18, S19 and S110 from top to bottom, the signal output terminal of V11 is electrically connected to S11, the signal output terminal of V11 is electrically connected to the signal input terminal of V12, the signal output terminal of V12 is electrically connected to S13, the signal output terminal of V12 is electrically connected to the signal input terminal of V13, the signal output terminal of V13 is electrically connected to S15, the signal output terminal of V13 is electrically connected to the signal input terminal of V14, the signal output terminal of V14 is electrically connected to S17, the signal output terminal of V14 is electrically connected to the signal input terminal of V15, and the signal output terminal of V15 is electrically connected to S19. Of course, the structures of the first scan control circuits V1 and the second scan control circuits V2 in the embodiment can be any structures known by those skilled in the art which are enable the second scan signal lines S2 in each second display area to be scanned successively and every pair of second scan signal lines S2 at each stage in the two second display areas to be scanned synchronously.

The above-mentioned connections of the cascaded scan control circuits can enable the second scan signal lines S2 in each of the second display areas to be scanned successively and the second scan signal lines S2 at the same stage in the two second display areas to be scanned synchronously, via the second scan control circuits V2.

In the conventional display panel illustrated by FIG. 1, the second scan signal lines S2 in each second display area are scanned successively through arrangement of the second scan control circuits V2 on two opposite sides of the second display area. While as illustrated by FIG. 7, in the embodiment of the disclosure, the second scan signal lines S2 in each second display area are scanned successively when the second scan control circuits V2 are arranged only in the third peripheral areas z3, which can not only release space of the spacing area B effectively to avoid arranging too many signal lines in the upper border area and to facilitate implementation of a narrow bezel design, but also ensure normal scanning without changing the structures of the second scan control circuits V2. Moreover, comparing with the conventional display panel, the embodiments of the disclosure ensure that a PW of clock signals input by each clock signal line to the second scan control circuits V2 remains unchanged, that is, charging time for each row remains unchanged. In addition, the embodiments ensure that the scan frequency of the second display areas is the same as that in the conventional display panel so that the display panel displays images normally.

Figure 8:
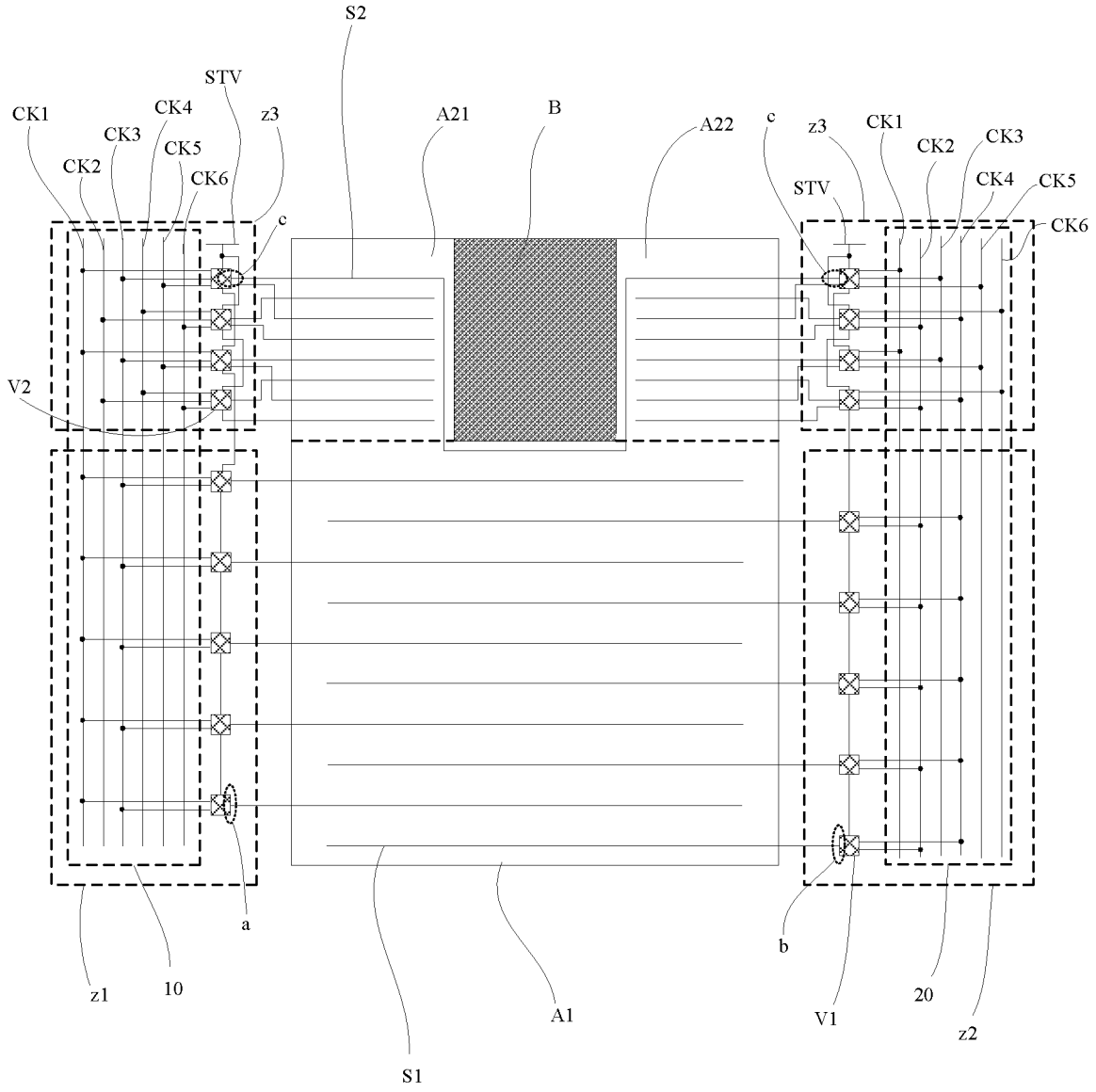

In still another implementation mode, since the second scan control circuits V2 are all arranged in the third peripheral areas z3 according to the embodiment of the disclosure, the second scan control circuits V2 crowd the third peripheral areas z3, and interference may occur between different second scan control circuits V2. In order to avoid the interference between different second scan control circuits V2, in this implementation mode, as illustrated by FIG. 8, two second scan signal lines S2 in a same second display area are electrically connected to a second scan control circuit V2 correspondingly, thereby reducing the number of second scan control circuits V2 by half, increasing space between different second scan control circuits V2 significantly, avoiding the mutual interferences between different second scan control circuits V2 effectively, and increasing reliability of the second scan control circuits V2. Moreover, to ensure that the second scan signal lines S2 in each of the second display areas are scanned successively, each of the first group of clock signal lines 10 and the second group of clock signal lines 20 can include a first clock signal line CK1 to a sixth clock signal line CK6. The first clock signal line CK1 to the sixth clock signal line CK6 input clock signals successively.

In an embodiment of the disclosure, two second scan signal lines S2 spaced by another second scan signal line S2 in a same second display area are electrically connected to one second scan control circuit V2 correspondingly to ensure normal display of images.

In an embodiment, as illustrated by FIG. 8, when each of the first group of clock signal lines 10 and the second group of clock signal lines 20 includes a first clock signal line CK1 to a sixth clock signal line CK6, connections of each group of clock signal lines with the first scan control circuits V1 and with the second scan control circuits V2 are as follows.

On one side of the display area, first scan control circuits V1 are electrically connected to the first clock signal line CK1 and the third clock signal line CK3 in the first group of clock signal lines 10, respectively. In every two adjacent second scan control circuits V2, one second scan control circuit V2 is electrically connected to the first clock signal line CK1, the third clock signal line CK3 and the fifth clock signal line CK5 in the first group of clock signal lines 10, and the other second scan control circuit V2 is electrically connected to the second clock signal line CK2, the fourth clock signal line CK4 and the sixth clock signal line CK6 in the first group of clock signal lines 10.

On the other side of the display area, first scan control circuits V1 are electrically connected to the second clock signal line CK2 and the fourth clock signal line CK4 in the second group of clock signal lines 20, respectively. In every two adjacent second scan control circuits V2, one second scan control circuit V2 is electrically connected to the first clock signal line CK1, the third clock signal line CK3 and the fifth clock signal line CK5 in the second group of clock signal lines 20, and the other second scan control circuit V2 is electrically connected to the second clock signal line CK2, the fourth clock signal line CK4 and the sixth clock signal line CK6 in the second group of clock signal lines 20.

For example, as illustrated by FIG. 8, if the four second scan control circuits V2 on the left side of the left second display area (A21) are denoted by V21, V22, V23 and V24 successively from top to bottom. Each of V21 and V23 is electrically connected to the first clock signal line CK1, the third clock signal line CK3 and the fifth clock signal line CK5 in the first group of clock signal lines 10. And each of V22 and V24 is electrically connected to the second clock signal line CK2, the fourth clock signal line CK4 and the sixth clock signal line CK6 in the first group of clock signal lines 10. Similarly, connections of the four second scan control circuits V2 on the right side of the right second display area with the second group of clock signal lines 20 are arranged in the same way as those on the left side, and repeated descriptions thereof are omitted herein.

Moreover, in the structure illustrated by FIG. 8, the second scan signal lines S2 in each second display area are scanned successively, and second scan signal lines S2 in the two second display areas are scanned synchronously. However, since second scan control circuits V2 in two third peripheral areas z3 input scan signals to the second scan signal lines S2 in the two second display areas under the action of the first group of clock signal lines 10 or the second group of clock signal lines 20, a difference in display may occur, causing display unevenness. Therefore, in an embodiment of the disclosure, as illustrated by FIG. 8, second scan signal lines S2 farthest away from the first display area A1 in the two second display areas can be electrically connected to eliminate the display unevenness of the two second display areas.

In addition, in an embodiment of the disclosure, connections of the cascaded first scan control circuits V1 and connections of the cascaded second scan control circuits V2 are as follows.

The peripheral area can further include start signal lines on two opposite sides of the display area. The start signal lines are configured to provide start signals to second scan control circuits at a first stage and at a second stage, respectively. That is, the start signal lines provide the start signals to the STVs of the second scan control circuits at the first stage and at the second stage, respectively. First signal output terminals of second scan control circuits at each stage are electrically connected to two corresponding second scan signal lines. First signal output terminals of first scan control circuits at each stage are electrically connected to a corresponding first scan signal line. Except second scan control circuits at last two stages, second signal output terminals of second scan control circuits at each odd stage are electrically connected to signal input terminals of second scan control circuit at next odd stage, and second signal output terminals of second scan control circuits at each even stage are electrically connected to signal input terminals of second scan control circuits at next even stage. Except first scan control circuits at the last stage, second signal output terminals of first scan control circuits at each stage are electrically connected to signal input terminals of first scan control circuits at next stage.

On one side of the display area, a second signal output terminal of a second scan control circuit at the last odd stage is electrically connected to the signal input terminal of the first scan control circuit at the first stage, and on the other side of the display area, a second signal output terminal of a second scan control circuit at the last even stage is electrically connected to the signal input terminal of the first scan control circuit at the first stage (as illustrated by FIG. 8). Or, on one side of the display area, a second signal output terminal of a second scan control circuit at the last stage is electrically connected to the signal input terminal of the first scan control circuit at the first stage; and on the other side of the display area, a second signal output terminal of a second scan control circuit at the last stage is electrically connected to the signal input terminal of the first scan control circuit at the first stage (not illustrated).

In other words, the difference between the two kinds of connections above is how the second scan control circuits provide effective pulse signals to the first scan control circuits. In the first kind of connections illustrated by FIG. 8, the first scan control circuits are controlled by the time sequence of the effective pulse signals provided by the second scan control circuits, so that the first scan signal lines can be scanned successively. Whereas in second kind of connections (not illustrated), the first scan control circuits are controlled by the time sequence of the clock signals, so that the first scan signal lines can be scanned successively. In both kinds of connections, every pair of second scan signal lines at each stage in the two second display areas can be scanned synchronously, and the first scan signal lines in the first display area can be scanned successively, thereby achieving the desired display function.

For example, in the structure illustrated by FIG. 8, if the four second scan control circuits V2 on the left side of the left second display area (A21) are denoted by V21, V22, V23 and V24 from top to bottom, and the second scan signal lines S2 in the left second display area (A21) are denoted by L21, L22, L23, L24, L25, L26, L27 and L28 from top to bottom, the first signal output terminal of V21 is electrically connected to L21 and L23, respectively, the second signal output terminal of V21 is electrically connected to the signal input terminal of V23, the first signal output terminal of V22 is electrically connected to L22 and L24, respectively, the second signal output terminal of V22 is electrically connected to the signal input terminal of V24, the first signal output terminal of V23 is electrically connected to L25 and L27, respectively, and the first signal output terminal of V24 is electrically connected to L26 and L28, respectively. Connections of the cascaded second scan control circuits V2 on the right side of the right second display area (A22) are arranged in the same way as those on the left side, and a repeated description thereof is omitted herein.

As such, when the number of second scan signal lines S2 in the second display areas illustrated by FIG. 8 is double the number of second scan signal lines S2 in the second display areas illustrated by FIG. 4, the number of second scan control circuits V2 does not increase. Therefore, with this implementation mode, fewer second scan control circuits V2 can be used to scan the same number of second scan signal lines S2, greatly reducing area of the peripheral area and enlarging space between different second scan control circuits V2 to avoid interference.

Moreover, this implementation mode uses a scanning method same as the conventional display panel without changing the structures of the second scan control circuits V2. Also, comparing with the conventional display panel, this implementation mode ensures that a PW of clock signals input by each clock signal line to the second scan control circuits V2 remains unchanged, that is, charging time for each row remains unchanged. Plus, the embodiments ensure that a scan frequency of the second display areas is the same as that in the conventional display panel so that the display panel displays images normally.

In an embodiment, to ensure that one second scan control circuit is electrically connected with two second scan signal lines and that one first scan control circuit is electrically connected with a first scan signal line, the structures of the first and second scan control circuits can be different. In other words, as illustrated by FIG. 9, each of the first scan control circuits can include a storage sub-circuit, an NAND gate sub-circuit and an amplification sub-circuit, all connected in series, and each of the second scan control circuits can also include a storage sub-circuit, two NAND gate sub-circuits connected with the storage sub-circuits and two amplification sub-circuits connected with the two NAND gate sub-circuits.

Figure 9:
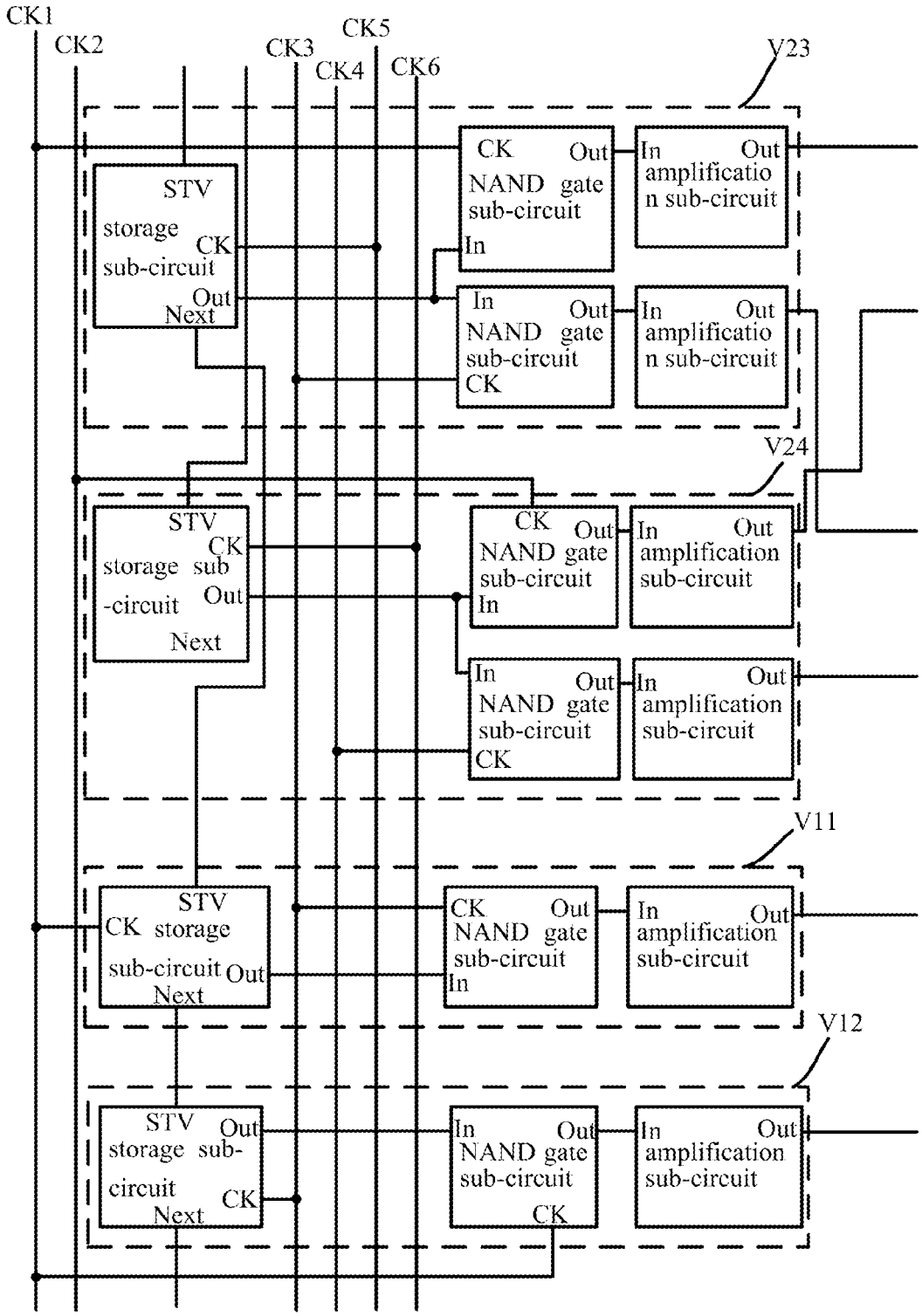
FIG. 9 is a circuit block diagram according to an embodiment of the disclosure.

In the embodiment illustrated by the circuit block diagrams in FIG. 9, in two adjacent first scan control circuits, the storage sub-circuit of one first scan control circuit is electrically connected to the first clock signal line in the first group of clock signal lines, and the NAND gate sub-circuit of the first scan control circuit is electrically connected to the third clock signal line in the first group of clock signal lines. The storage sub-circuit of the other first scan control circuit is electrically connected to the third clock signal line in the first group of clock signal lines, and the NAND gate sub-circuit of the other first scan control circuit is electrically connected to the first clock signal line in the first group of clock signal lines.

In two adjacent second scan control circuits, the storage sub-circuit of one second scan control circuit is electrically connected to the first clock signal line in the first group of clock signal lines, one NAND gate sub-circuit of the second scan control circuit is electrically connected to the third clock signal line in the first group of clock signal lines, and the other NAND gate sub-circuit of the second scan control circuit is electrically connected to the fifth clock signal line in the first group of clock signal lines. The storage sub-circuit of the other second scan control circuit is electrically connected to the second clock signal line in the first group of clock signal lines. One NAND gate sub-circuit of the other second scan control circuit is electrically connected to the fourth clock signal line in the first group of clock signal lines. The other NAND gate sub-circuit of the other second scan control circuit is electrically connected to the sixth clock signal line in the first group of clock signal lines.

For three second scan control circuits separated from each other by other second scan control circuits, when the three second scan control circuits are electrically connected to the first, third and fifth clock signal lines in the first group of clock signal lines, respectively, the storage sub-circuit of one second scan control circuit is electrically connected to the first clock signal line in the first group of clock signal lines, one NAND gate sub-circuit of the second scan control circuit is electrically connected to the third clock signal line in the first group of clock signal lines, and another NAND gate sub-circuit of the second scan control circuit is electrically connected to the fifth clock signal line in the first group of clock signal lines. The storage sub-circuit of another second scan control circuit is electrically connected to the third clock signal line in the first group of clock signal lines, an NAND gate sub-circuit of this second scan control circuit is electrically connected to the fifth clock signal line in the first group of clock signal lines, and the other NAND gate sub-circuit of this second scan control circuit is electrically connected to the first clock signal line in the first group of clock signal lines. The storage sub-circuit of still another second scan control circuit of the three second scan control circuits separated from each other is electrically connected to the fifth clock signal line in the first group of clock signal lines, an NAND gate sub-circuit of this second scan control circuit is electrically connected to the first clock signal line in the first group of clock signal lines, and the other NAND gate sub-circuit of this second scan control circuit is electrically connected to the third clock signal line in the first group of clock signal lines.

It is noteworthy that, when three second scan control circuits are separated from each other by other second scan control circuits are electrically connected to the second, fourth and sixth clock signal lines in the first group of clock signal lines, respectively, the connections of storage sub-circuits and NAND gate sub-circuits with clock signal lines are similar to the abovementioned connections, and a repeated description thereof is omitted here.

Moreover, in the embodiment of the disclosure illustrated by FIG. 9, except the first scan control circuit at the last stage, a storage sub-circuit of a first scan control circuit at each stage inputs an effective pulse signal to a storage sub-circuit of a first scan control circuit at the next stage. And except the second scan control circuits at the last two stages, a storage sub-circuit of a second scan control circuit at each odd stage inputs an effective pulse signal to a storage sub-circuit of a second scan control circuit at the next odd stage, and a storage sub-circuit of a second scan control circuit at each even stage inputs an effective pulse signal to a storage sub-circuit of a second scan control circuit at the next even stage.

On one side of the display area, a storage sub-circuit of a second scan control circuit at the last odd stage inputs an effective pulse signal to a storage sub-circuit of a first scan control circuit at the first stage, and on the other side of the display area, a storage sub-circuit of a second scan control circuit at the last even stage inputs an effective pulse signal to a storage sub-circuit of a first scan control circuit at the first stage. Or, on one side of the display area, a storage sub-circuit of a second scan control circuit at the last stage inputs an effective pulse signal to a storage sub-circuit of a first scan control circuit at the first stage; and on the other side of the display area, a storage sub-circuit of a second scan control circuit at the last stage inputs an effective pulse signal to a storage sub-circuit of a first scan control circuit at the first stage.

The arrangement above ensures that all the first scan signal lines in the first display area are scanned successively and all the second scan signal lines in each of the second display areas are scanned successively, so that the entire display area can display images normally.

The first scan control circuits V11 and V12 and the second scan control circuits V23 and V24 are illustrated by FIG. 9. Assuming that V23 and V24 are second scan control circuits at the last two stages on the left side of the left second display area (A21) illustrated by FIG. 8, in the second scan control circuits V23 and V24, the storage sub-circuit of V23 is electrically connected to the fifth clock signal line CK5, one NAND gate sub-circuit of V23 is electrically connected to the first clock signal line CK1, the other NAND gate sub-circuit of V23 is electrically connected to the third clock signal line CK3, the storage sub-circuit of V24 is electrically connected to the sixth clock signal line CK6, one NAND gate sub-circuit of V24 is electrically connected to the second clock signal line CK2, another NAND gate sub-circuit of V24 is electrically connected to the fourth clock signal line CK4 and V23 inputs an effective pulse signal to the signal input terminal STV of V11.

In the first scan control circuits V11 and V12, the storage sub-circuit of V11 is electrically connected to the first clock signal line CK1, the NAND gate sub-circuit of V11 is electrically connected to the third clock signal line CK3, the storage sub-circuit of V12 is electrically connected to the third clock signal line CK3, the NAND gate sub-circuit of V12 is electrically connected to the first clock signal line CK1, and V11 inputs an effective pulse signal to the signal input terminal STV of V12, to ensure that the first and second display areas can implement the display function and display images normally.

Of course, the structures of the storage sub-circuits, NAND gate sub-circuits and amplification sub-circuits of the first scan control circuits V1 and of the second scan control circuits V2 can be any structures known by those skilled in the art.

Figure 10:
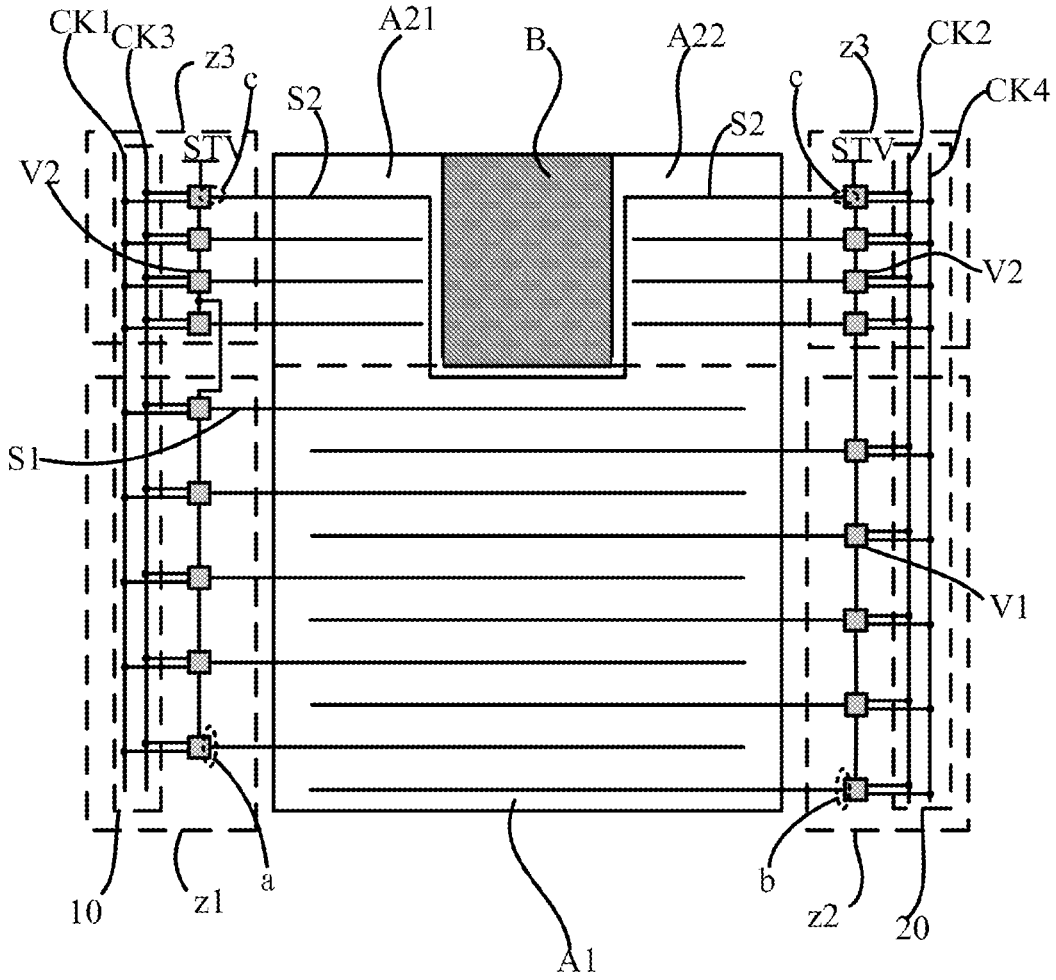
FIGS. 10-11 are structural schematic diagrams of display panels having two display areas according to some embodiments of the disclosure.

In still another implementation mode, as illustrated by FIG. 10, one second scan signal line S2 is electrically connected to one second scan control circuit V2 correspondingly, the first group of clock signal lines 10 can include a first clock signal line CK1 and a third clock signal line CK3, and the second group of clock signal lines 20 can include a second clock signal line CK2 and a fourth clock signal line CK4. Moreover, on one side of the display area, first scan control circuits V1 and second scan control circuits V2 are all electrically connected to the first clock signal line CK1 and the third clock signal line CK3 in the first group of clock signal lines 10. On the other side of the display area, first scan control circuits V1 and second scan control circuits V2 are all electrically connected to the second clock signal line CK2 and the fourth clock signal line CK4 in the second group of clock signal lines 20. That is, for first scan control circuits V1 and second scan control circuits V2 located at a same side of the display area, their connections with the first group of clock signal lines 10 or with the second group of clock signal lines 20 are the same, which is different from the three implementation modes above. Such an arrangement does not need to increase the number of the clock signal lines on two opposite sides of the display area, and thus reduces the area occupied by the clock signal lines effectively and facilitates the implementation of the narrow bezel design.

In order to enable the second scan signal lines S2 in each of the second display areas to be scanned successively and each pair of second scan signal lines S2 at each stage in the two second display areas to be scanned synchronously, when only two clock signal lines are arranged in the third peripheral areas z3, a time sequence of clock signals input by each group of clock signal lines to the first scan control circuits V1 and the second scan control circuits V2 needs to be adjusted.

In an embodiment, the time sequence of the clock signals input by each of the first group of clock signal lines 10 and the second group of clock signal lines 20 to the first scan control circuits V1 is: the first clock signal line CK1 to the fourth clock signal line CK4 input clock signals successively. The time sequence of the clock signals input by each of the first group of clock signal lines 10 and the second group of clock signal lines 20 to the second scan control circuits V2 is: the first clock signal line CK1 and the second clock signal line CK2 input the first clock signals synchronously, the third clock signal line CK3 and the fourth clock signal line CK4 input the second clock signals synchronously, and the first and second clock signals are input successively.

By inputting clock signals having different time sequences to the first scan control circuits V1 and the second scan control circuits V2, not only that the second scan signal lines S2 in each of the second display areas can be scanned successively, but also that the first scan signal lines S1 in the first display area A1 can be scanned successively, so that the display panel can display images normally. Of course, if clock signals having different time sequences are to be input into the first scan control circuits V1 and the second scan control circuits V2, a driver chip providing the clock signals needs to be set correspondingly, so that the first scan control circuits V1 and the second scan control circuits V2 can work effectively.

Moreover, in the structure illustrated by FIG. 10, the second scan signal lines S2 in each second display area are scanned successively, and each pair of second scan signal lines S2 at each stage in the two second display areas are scanned synchronously. However, since the second scan control circuits V2 in two third peripheral areas z3 input scan signals to the second scan signal lines S2 in the two second display areas under the action of the first group of clock signal lines 10 or of the second group of clock signal lines 20, this arrangement may cause signal errors resulting in image infidelity. In addition, uniformity of image may show up. Therefore, in some embodiments of the disclosure, as illustrated by FIG. 10, second scan signal lines S2 farthest away from the first display area A1 in the two second display areas can be electrically connected to eliminate the display unevenness of the two second display areas.

In addition, in an embodiment of the disclosure, connections of the cascaded first scan control circuits V1 and connections of the cascaded second scan control circuits V2 are as follows.

The peripheral area can further include start signal lines on two opposite sides of the display area. The start signal lines are configured to provide start signals to second scan control circuits at a first stage. That is, the start signal lines are configured to provide the start signals to the STVs of the second scan control circuits at the first stage. First signal output terminals of second scan control circuits at each stage are electrically connected to corresponding second scan signal lines. First signal output terminals of first scan control circuits at each stage are electrically connected to corresponding first scan signal lines. Except second scan control circuits at the last stage, second signal output terminals of second scan control circuits at each stage are electrically connected to signal input terminals of second scan control circuit at next stage. Except first scan control circuits at the last stage, second signal output terminals of first scan control circuits at each stage are electrically connected to signal input terminals of first scan control circuits at next stage.

On one side of the display area, a second signal output terminal of a second scan control circuit at the last stage is electrically connected to the signal input terminal of the first scan control circuit at the first stage, and on the other side of the display area, a second signal output terminal of a second scan control circuit at the second last stage is electrically connected to the signal input terminal of the first scan control circuit at the first stage (as illustrated by FIG. 10). Or, on one side of the display area, a second signal output terminal of a second scan control circuit at the last stage is electrically connected to the signal input terminal of the first scan control circuit at the first stage; and on the other side of the display area, a second signal output terminal of a second scan control circuit at the last stage is electrically connected to the signal input terminal of the first scan control circuit at the first stage (not illustrated).

That is, the difference between the above-mentioned two kinds of connections is how the second scan control circuits provide effective pulse signals to the first scan control circuits. In the first kind of connections illustrated by FIG. 10, the first scan control circuits are controlled by the time sequence of the effective pulse signals provided by the second scan control circuits, so that the first scan signal lines can be scanned successively. Whereas in the second kind of connections (not illustrated), the first scan control circuits are controlled by the time sequence of the clock signals, so that the first scan signal lines can be scanned successively. With both kinds of connections, every pair of second scan signal lines at each stage in the two second display areas can be scanned synchronously, and the first scan signal lines in the first display area can be scanned successively, thereby achieving the desired display function.

For example, in the structure illustrated by FIG. 10, if the four second scan control circuits V2 on the left side of the left second display area (A21) are denoted by V21, V22, V23 and V24 from top to bottom, and the second scan signal lines S2 in the left second display area (A21) are denoted by L21, L22, L23 and L24 from top to bottom, the first signal output terminal of V21 is electrically connected to L21, the second signal output terminal of V21 is electrically connected to the signal input terminal of V22. The first signal output terminal of V22 is electrically connected to L22 and the second signal output terminal of V22 is electrically connected to the signal input terminal of V23. The first signal output terminal of V23 is electrically connected to L23 and the second signal output terminal of V23 is electrically connected to the signal input terminal of V24. The first signal output terminal of V24 is electrically connected to L24. Connections of the cascaded second scan control circuits V2 on the right side of the right second display area (A22) are arranged in the same way as those on the left side, and a repeated description thereof is omitted herein.

If the first scan control circuits V1 on the left side of the first display area A1 are denoted by V11, V12, V13, V14 and V15 from top to bottom, and the first scan signal lines S1 in the first display area A1 are denoted by S11, S12, S13, S14, S15, S16, S17, S18, S19 and S110 from top to bottom, the first signal output terminal of V11 is electrically connected to S11, the second signal output terminal of V11 is electrically connected to the signal input terminal of V12, the first signal output terminal of V12 is electrically connected to S13, the second signal output terminal of V12 is electrically connected to the signal input terminal of V13, the first signal output terminal of V13 is electrically connected to S15, the second signal output terminal of V13 is electrically connected to the signal input terminal of V14, the first signal output terminal of V14 is electrically connected to S17, the second signal output terminal of V14 is electrically connected to the signal input terminal of V15, and the first signal output terminal of V15 is electrically connected to S19.

The above-mentioned connections of the cascaded scan control circuits can enable the second scan signal lines S2 in each of the second display areas to be scanned successively and the second scan signal lines S2 at the same stage in the two second display areas to be scanned synchronously, via the second scan control circuits V2. Of course, the structures of the first scan control circuits V1 and the second scan control circuits V2 in the embodiment can be any structures known by those skilled in the art which are enable the second scan signal lines S2 in each second display area to be scanned successively and every pair of second scan signal lines S2 at each stage in the two second display areas to be scanned synchronously.

In the conventional display panel illustrated by FIG. 1, the second scan signal lines S2 in each second display area are scanned successively through arrangement of the second scan control circuits V2 on two opposite sides of the second display area. While as illustrated by FIG. 10, in the embodiment of the disclosure, the second scan signal lines S2 in each second display area are scanned successively when the second scan control circuits V2 are arranged only in the third peripheral areas z3, which can not only release space of the spacing area B effectively to avoid arranging too many signal lines in the upper border area and to facilitate implementation of a narrow bezel design, but also ensure normal scanning without changing the structures of the second scan control circuits V2. Moreover, comparing with the conventional display panel, the embodiments of the disclosure ensure that a PW of clock signals input by each clock signal line to the second scan control circuits V2 remains unchanged, that is, charging time for each row remains unchanged. In addition, the embodiments ensure that a scan frequency of the second display areas is the same as that in the conventional display panel so that the display panel displays images normally.

In summary, Table 1 shows simulation results of the four implementation modes described above, where "the number of stages of the second scan control circuits" is the number of stages of second scan control circuit on one side of the area A21 or of the area A22. Comparing with the conventional display panel illustrated in FIG. 1, the number of stages of the second scan control circuits V2 in the disclosure is larger, however, each of the four implementation modes ensures that the pulse width is the same as the normal pulse width for each clock signal, thereby providing adequate charging time of each row of pixels, minimizing impact to existing display panel's functions meanwhile improving display performance

TABLE 1

| | the conventional display panel | Embodiments of the disclosure |
|---|---|---|
| Aspect ratio (display width to height) | 18:9 | 18:9 |
| The number of stages of second scan control circuits | 128 | 256 |
| Pulse width of clock signals (microseconds) | 8.20 | 8.20 |

Two implementation modes can be used when the second scan control circuits V2 in the third peripheral areas z3 input scan signals to electrically connected second scan signal lines S2 under the control of the first group of clock signal lines 10 or the second group of clock signal lines 20, so that second scan signal lines S2 at each stage in the two second display areas are scanned alternately.

Figure 11:
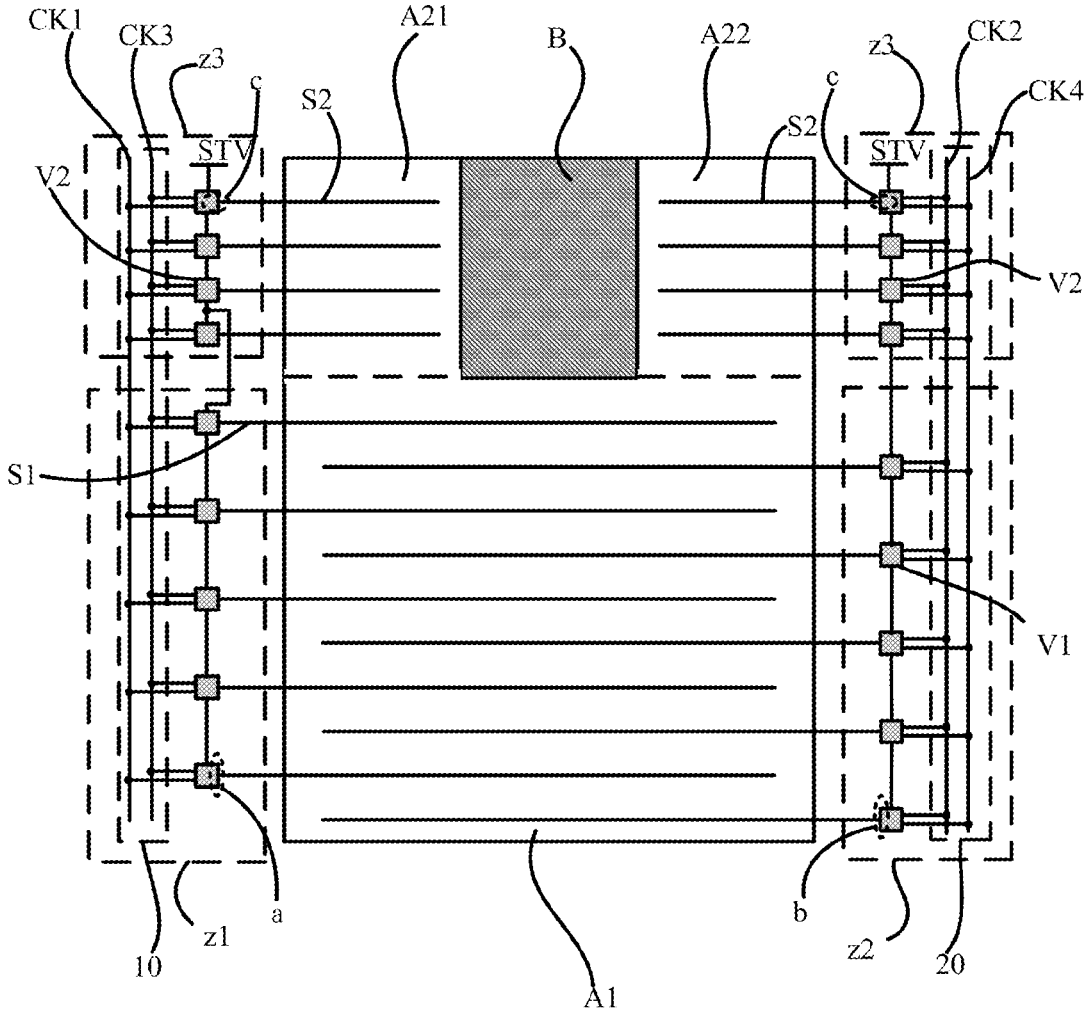

In one of the two implementation modes, as illustrated by FIG. 11, similarly, one second scan signal line S2 is electrically connected to one second scan control circuit V2 correspondingly. The first group of clock signal lines 10 can include a first clock signal line CK1 and a third clock signal line CK3. The second group of clock signal lines 20 can include a second clock signal line CK2 and a fourth clock signal line CK4. Moreover, on one side of the display area, the first scan control circuits V1 and the second scan control circuits V2 are all electrically connected to the first clock signal line CK1 and the third clock signal line CK3 in the first group of clock signal lines 10. On the other side of the display area, the first scan control circuits V1 and the second scan control circuits V2 are all electrically connected to the second clock signal line CK2 and the fourth clock signal line CK4 in the second group of clock signal lines 20. That is, for first scan control circuits V1 and second scan control circuits V2 on a same side of the display area, their connections with the first group of clock signal lines 10 or the second group of clock signal lines 20 are the same, which is different from the first three implementation modes illustrated by FIGS. 4-5, 7 and 8, respectively. Such arrangement does not need to increase the number of the clock signal lines at two opposite sides of the display area, and can reduce the area occupied by the peripheral area at two opposite sides of the display area effectively, facilitating the implementation of the narrow bezel design.

It is noteworthy that this implementation mode is different from the four implementation modes described above. In the four implementation modes described above, each pair of second scan signal lines S2 at each same stage in the two second display areas are scanned synchronously, while in this implementation mode, second scan signal lines S2 at each stage in the two second display areas are scanned alternately. Obviously, this implementation mode changes the previous scan frequency, that is, comparing with the scan frequency of the conventional display panel, the scan frequency is reduced almost by half, which may have a significant effect on user experience.

In order to avoid the scan frequency from decreasing significantly in this implementation mode, when only two clock signal lines are arranged in the third peripheral areas z3, the time sequence of the clock signals input by each group of clock signal lines respectively to the first scan control circuits V1 and the second scan control circuits V2 needs to be adjusted.

In an embodiment, the first clock signal line CK1 to the fourth clock signal line CK4 input clock signals successively. The pulse width of the clock signals input by the first group of clock signal lines 10 and the second group of clock signal lines 20 to the first scan control circuits V1 is greater than the pulse width of the clock signals input by the first group of clock signal lines 10 and the second group of clock signal lines 20 to the second scan control circuits V2.

By inputting clock signals having different time sequences to the first scan control circuits V1 and the second scan control circuits V2, the second scan signal lines S2 in each second display area are scanned successively, a significant decrease of the scan frequency of the second scan signal lines S2 is effectively avoided, and the first scan signal lines S1 in the first display area A1 are scanned successively, so that the display panel can display images normally. Of course, a driver chip providing the clock signals needs to be set to input clock signals having different time sequences to the first scan control circuits V1 and to the second scan control circuits V2, so that the first scan control circuits V1 and the second scan control circuits V2 can operate effectively.

Furthermore, as illustrated by FIG. 11, since second scan signal lines S2 at each stage in the two second display areas are scanned alternately, the second scan signal lines S2 farthest away from the first display area A1 in the two second display areas do not need to be electrically connected, thereby simplifying the structure of the display panel.

Moreover, in this implementation mode, two kinds of connections also exist between the cascaded first scan control circuits V1 and between the cascaded second scan control circuits V2, where one of the two kinds of connections is illustrated by FIG. 11, and the other kind of connections is not illustrated in the figures). These two kinds of connections are arranged in the same way as the connections between the cascaded first scan control circuits V1 and between the cascaded second scan control circuits V2 in the implementation mode illustrated by FIG. 10. For details please refer to the implementation mode illustrated by FIG. 10, and a repeated description thereof is omitted here.

In the conventional display panel illustrated by FIG. 11, the second scan signal lines S2 in each second display area are scanned successively and the second scan signal lines S2 at each stage in the two second display areas are scanned synchronously through arrangement of the second scan control circuits V2 on two opposite sides of the second display area. While in this implementation mode, the second scan signal lines S2 in each second display area are scanned successively and the second scan signal lines S2 at each stage in the two second display areas are scanned alternately through arrangement of the second scan control circuits V2 only in the third peripheral areas z3, which can not only release space of the spacing area B effectively to avoid arranging too many signal lines in the upper border area and to facilitate implementation of a narrow bezel design.

Furthermore, Table 2 shows simulation results of this implementation mode, where FHD represents a normal Full-High-Definition Display, and the pulse width of the FHD is taken as a reference. Wide Quad HD or WQHD is a display having a resolution of 2560×1440 pixels in a 16:9 aspect ratio (display width to display height ratio). The FHD and the WQHD are both normal displays, that is, the display area is only constituted by the first display area A1 according to the embodiments of the disclosure. The "number of stages of the first and second scan control circuits" is the number of stages of the first and second scan control circuits on a same side of the display area. The "conventional display" refers to the display whose display area is constituted by a first display area A1 and two second display areas as illustrated by FIG. 1, whereas "embodiment of the disclosure" refers to a display whose display area is constituted by a first display area A1 and two second display areas as illustrated by any one of the FIGS. 4 to 11.

According to the simulation results of this implementation mode, the number of stages of the second scan control circuits V2 in the disclosure is increased comparing with the conventional display panel illustrated by FIG. 1, but this implementation mode can make the scan frequency close to the scan frequency of the conventional display as much as possible by reducing the pulse width of the clock signals input to the second scan control circuits V2, thereby having no effect on the display effect of images. Although the pulse width is reduced, since the reduced pulse width (7.72 microseconds) is still longer than the pulse width (6.56 microseconds) of the WQHD display, the reduced pulse width would not have a great effect on the charging capability of the display panel and thus would not have a great effect on the display effect of the display panel.

TABLE 2

| | FHD | Conventional Display | Embodiment of the disclosure | WQHD |
|---|---|---|---|---|
| Aspect ratio (display width to height) | 16:9 | 18:9 | 18:9 | 16:9 |
| The number of stages of the first and second scan control circuits | 1920 + 0 | 1920 + 128 | 1920 + 256 | 2560 + 0 |

TABLE 2-continued

| | FHD | Conventional Display | Embodiment of the disclosure | WQHD |
|---|---|---|---|---|
| Pulse width of clock signal (microseconds) | 8.75 | 8.20 | 7.72 | 6.56 |
| Reduced percentage (%) | 0.0 | 6.3 | 11.8 | 25.0 |

It is noteworthy that usually the first scan control circuits V1 and the second scan control circuits V2 need to be reset in their operation process to ensure the normal operation of the scan control circuits, and all the five implementation modes described above according to the embodiments of the disclosure can use the clock signal lines to provide reset signals to reset the scan control circuits. In this way, the number of wires arranged in the peripheral area can be reduced to release space of the peripheral area and facilitate the implementation of the narrow bezel design.

Furthermore, for the implementation modes illustrated by FIGS. 10 and 11, although time sequences are different, but connections of the cascaded first scan control circuits and of the cascaded second scan control circuits are essentially the same, and the details thereof can be referred to FIGS. 10 and 11. Moreover, in a specific implementation, for either the implementation mode illustrated by FIG. 10 or the implementation mode illustrated by FIG. 11, each of the first scan control circuit and the second scan control circuit can include one storage sub-circuit, one NAND gate sub-circuit and one amplification sub-circuit which are connected in series, as illustrated by FIG. 12, and FIG. 12 corresponds to FIG. 11.

Figure 12:
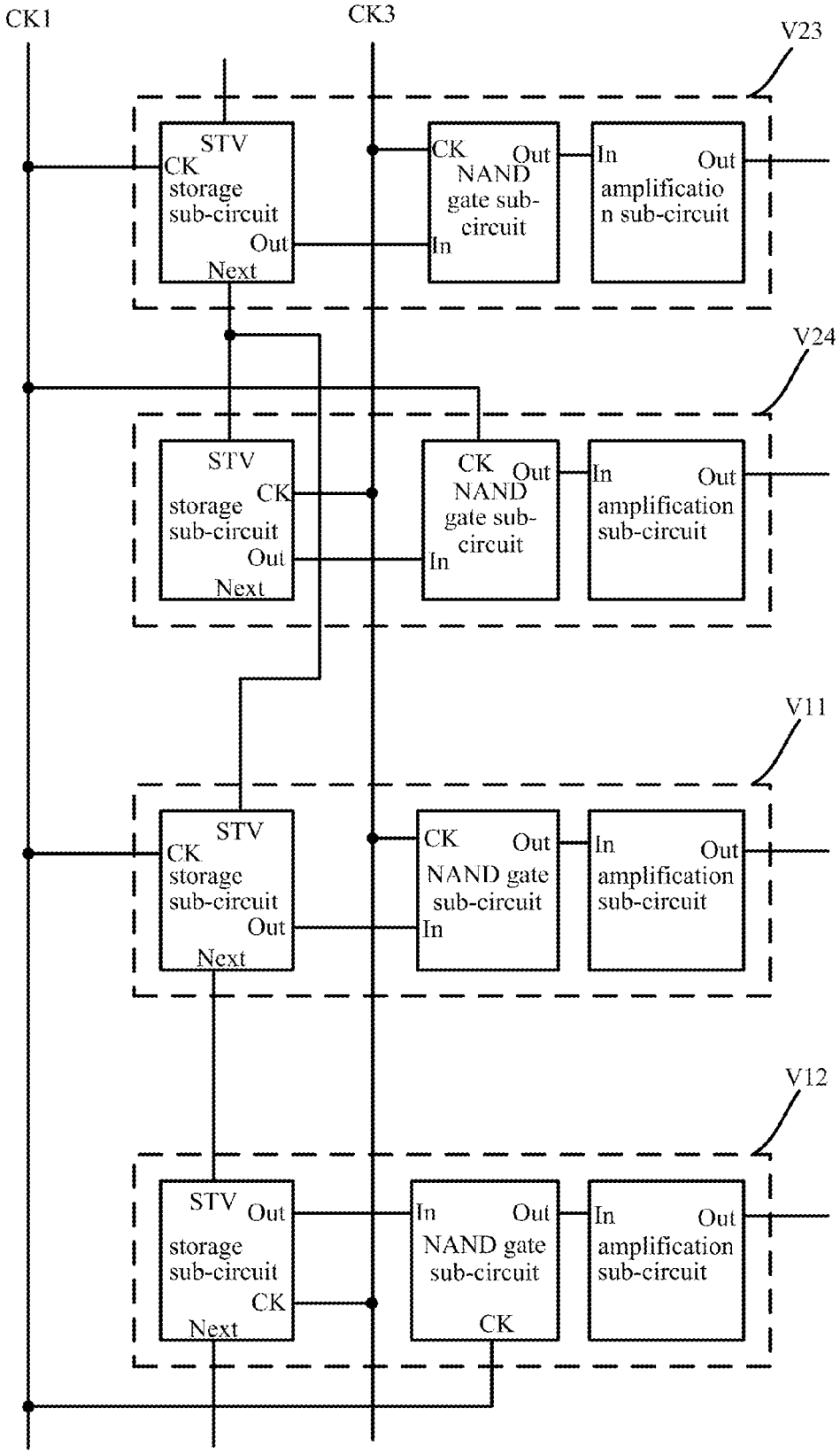
FIG. 12 is a circuit block diagram according to an embodiment of the disclosure.

In an embodiment, as illustrated by FIG. 12, in every two adjacent first scan control circuits, the storage sub-circuit of one first scan control circuit is electrically connected to the first clock signal line in the first group of clock signal lines, and the NAND gate sub-circuit of one of this first scan control circuit is electrically connected to the third clock signal line in the first group of clock signal lines; the storage sub-circuit of the other first scan control circuit is electrically connected to the third clock signal line in the first group of clock signal lines, and the NAND gate sub-circuit of this first scan control circuit is electrically connected to the first clock signal line in the first group of clock signal lines.

In every two adjacent second scan control circuits, the storage sub-circuit of one second scan control circuit is electrically connected to the first clock signal line of the first group of clock signal lines, and the NAND gate sub-circuit of one of this second scan control circuit is electrically connected to the third clock signal line in the first group of clock signal lines; the storage sub-circuit of the other second scan control circuit is electrically connected to the third clock signal line in the first group of clock signal lines, and the NAND gate sub-circuit of this second scan control circuit is electrically connected to the first clock signal line in the first group of clock signal lines.

In every adjacent first scan control circuit and second scan control circuit, the storage sub-circuit of the first scan control circuit is electrically connected to the first clock signal line in the first group of clock signal lines, and the NAND gate sub-circuit of the first scan control circuit is electrically connected to the third clock signal line in the first group of clock signal lines; the storage sub-circuit of the second scan control circuit is electrically connected to the third clock signal line in the first group of clock signal lines, and the NAND gate sub-circuit of the second scan control circuit is electrically connected to the first clock signal line in the first group of clock signal lines.

Moreover, in an embodiment of the disclosure, as illustrated by FIG. 12, except the first scan control circuits at the last stage, the storage sub-circuit of the first scan control circuit at each stage inputs an effective pulse signal to the storage sub-circuit of the first scan control circuit at a next stage. Except the second scan control circuit at the last stage, the storage sub-circuit of the second scan control circuit at each stage inputs an effective pulse signal to the storage sub-circuit of the second scan control circuit at a next stage.

On one side of the display area, the storage sub-circuit of the second scan control circuit at the last stage inputs an effective pulse signal to the storage sub-circuit of the first scan control circuit at the first stage; and on the other side of the display area, the storage sub-circuit of the second scan control circuit at the second last stage inputs an effective pulse signal to the storage sub-circuit of the first scan control circuit at the first stage (as illustrated by FIG. 12). Or, on one side of the display area, the storage sub-circuit of the second scan control circuit at the last stage inputs an effective pulse signal to the storage sub-circuit of the first scan control circuit at the first stage; and on the other side of the display area, the storage sub-circuit of the second scan control circuit at the last stage inputs an effective pulse signal to the storage sub-circuit of the first scan control circuit at the first stage (not illustrated).

Through the arrangement above, all the first scan signal lines in the first display area can be scanned successively and all the second scan signal lines in each second display area can be scanned successively, so that the entire display area can display images normally.

FIG. 12 illustrates the first scan control circuits V11 and V12 and the second scan control circuits V23 and V24. Assuming that V23 and V24 are the second scan control circuits at the last two stages on the left side of the left second display area (A21) illustrated by either FIG. 10 or 11. The storage sub-circuit of V23 is electrically connected to the first clock signal line CK1, the NAND gate sub-circuit of V23 is electrically connected to the third clock signal line CK3, the storage sub-circuit of V24 is electrically connected to the third clock signal line CK3, and the NAND gate sub-circuit of V24 is electrically connected to the first clock signal line CK1. Moreover, V23 inputs an effective pulse signal to the signal input terminal STV of V24 when inputting an effective pulse signal to the signal input terminal STV of V11 at the same time.

The storage sub-circuit of V11 is electrically connected to the first clock signal line CK1, the NAND gate sub-circuit of V11 is electrically connected to the third clock signal line CK3, the storage sub-circuit of V12 is electrically connected to the third clock signal line CK3, and the NAND gate sub-circuit of V12 is electrically connected to the first clock signal line CK1. Moreover, V11 inputs an effective pulse signal to the signal input terminal STV of V12, to ensure that the first and second display areas can implement the display function and display images normally.

Figure 13:
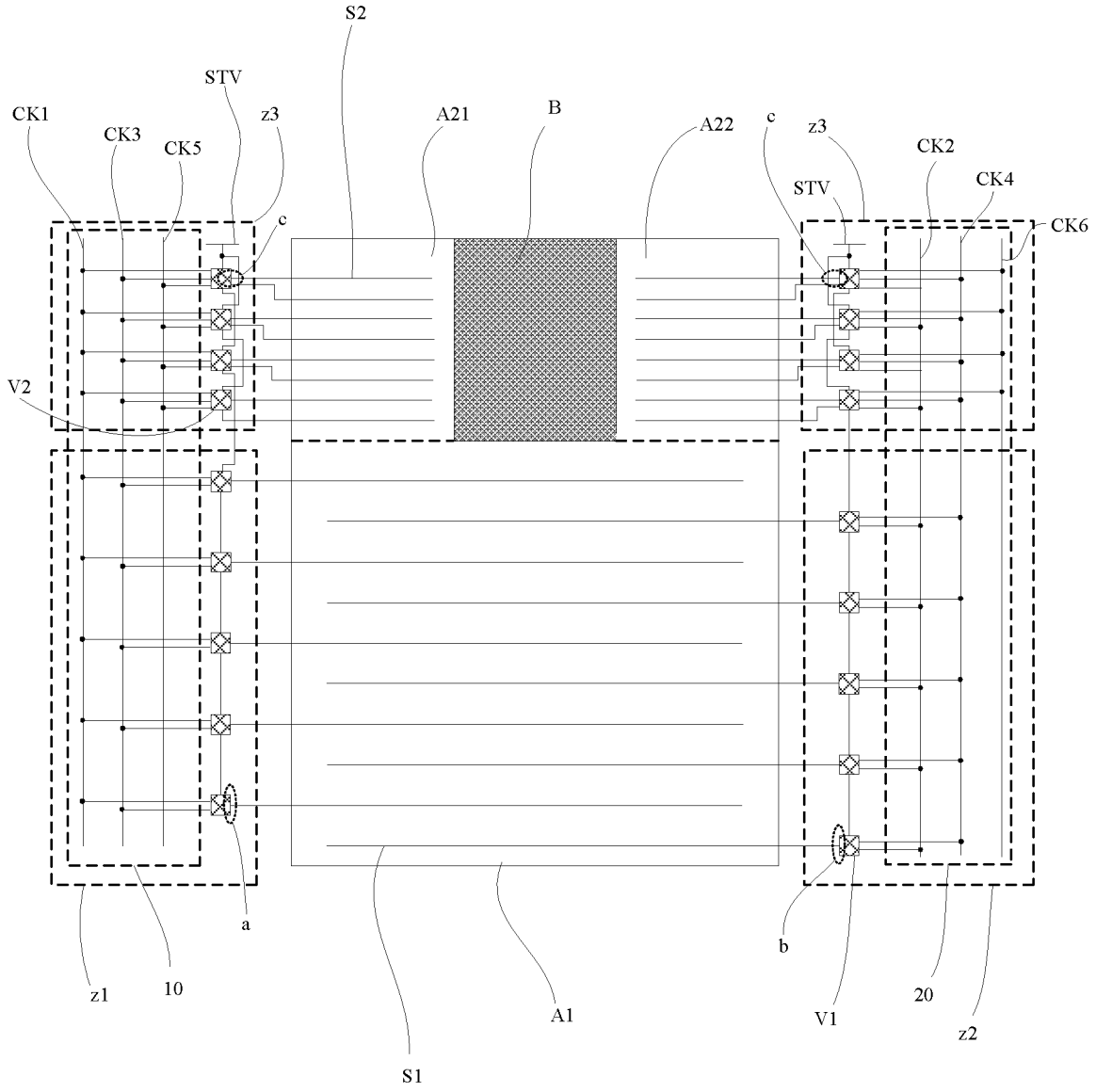
FIG. 13 is a structural schematic diagram of a display panel having two display areas according to an embodiment of the disclosure.

In the other of the two implementation modes, as illustrated by FIG. 13, where connections of the second scan control circuits at each stage with the second scan signal lines are different from those in the implementation mode illustrated by FIG. 8. In both implementation modes, one second scan control circuit V2 is electrically connected to two second scan signal lines S2 correspondingly, but in the implementation mode illustrated by FIG. 8, one second scan control circuit V2 is electrically connected to two second scan signal lines S2 separated by another second scan signal line S2 correspondingly, whereas in this implementation mode, one second scan control circuit V2 is electrically connected to two adjacent second scan signal lines S2 correspondingly. Thus this implementation mode can also reduce the area occupied by the peripheral area and facilitate the implementation of the narrow bezel design.

Furthermore, in order to enable alternate scanning of the second scan signal lines at each stage in the two second display areas, the first group of clock signal lines 10 includes a first clock signal line CK1, a third clock signal line CK3 and a fifth clock signal line CK5, and the second group of clock signal lines 20 includes a second clock signal line CK2, a fourth clock signal line CK4 and a sixth clock signal line CK6.

Moreover, on one side of the display area, the first scan control circuits V1 are electrically connected to the first clock signal line CK1 and the third clock signal line CK3 in the first group of clock signal lines 10, and the second scan control circuits V2 are electrically connected to the first clock signal line CK1, the third clock signal line CK3 and the fifth clock signal line CK5 in the first group of clock signal lines 10. And on the other side of the display area, the first scan control circuits V1 are electrically connected to the second clock signal line CK2 and the fourth clock signal line CK4 in the second group of clock signal lines 20, and the second scan control circuits V2 are electrically connected to the second clock signal line CK2, the fourth clock signal line CK4 and the sixth clock signal line CK6 in the second group of clock signal lines 20.

Since this implementation mode also intends to scan the second scan signal lines at each stage in the two second display areas alternately, this implementation mode also changes the original scan frequency, that is, comparing with the scan frequency of the conventional display panel illustrated by FIG. 1, the scan frequency is reduced almost by half, which may have a significant effect on the user's viewing effect. In order to avoid having an effect on the viewing effect, a significant decrease of the scan frequency needs to be avoided, so time sequences of the clock signals input by each group of clock signal lines respectively to the first scan control circuits V1 and the second scan control circuits V2 need to be adjusted.

In an embodiment, the first clock signal line CK1 to the sixth clock signal line CK6 input clock signals successively; and the pulse width of the clock signals input by the first group of clock signal lines 10 and the second group of clock signal lines 20 to the first scan control circuits V1 is greater than the pulse width of the clock signals input by the first group of clock signal lines 10 and the second group of clock signal lines 20 to the second scan control circuits V2.

By inputting clock signals having different time sequences to the first scan control circuits V1 and the second scan control circuits V2, the second scan signal lines S2 in each second display area are scanned successively, a significant decrease of the scan frequency of the second scan signal lines S2 is effectively avoided, and the first scan signal lines S1 in the first display area A1 are scanned successively, so that the display panel can display images normally. Of course, driver chips providing the clock signals need to be set to input clock signals having different time sequences to the first scan control circuits V1 and to the second scan control circuits V2, so that the first scan control circuits V1 and the second scan control circuits V2 can operate effectively.

Furthermore, as illustrated by FIG. 13, since second scan signal lines S2 at each stage in the two second display areas are scanned alternately, the second scan signal lines S2 farthest away from the first display area A1 in the two second display areas do not need to be electrically connected, thereby simplifying the structure of the display panel.

Moreover, in this implementation mode, two kinds of connections also exist between the cascaded first scan control circuits V1 and between the cascaded second scan control circuits V2, where one of the two kinds of connections is illustrated by FIG. 13, and the other kind of connections is not illustrated in the figures). These two kinds of connections are arranged in the same way as the connections between the cascaded first scan control circuits V1 and between the cascaded second scan control circuits V2 in the implementation mode illustrated by FIG. 8. For details please refer to the implementation mode illustrated by FIG. 8, and a repeated description thereof is omitted here.

In the conventional display panel illustrated by FIG. 1, the second scan signal lines S2 in each second display area are scanned successively and the second scan signal lines S2 at each stage in the two second display areas are scanned synchronously through arrangement of the second scan control circuits V2 on two opposite sides of the second display area. While in this implementation mode, the second scan signal lines S2 in each second display area are scanned successively and the second scan signal lines S2 at each stage in the two second display areas are scanned alternately through arrangement of the second scan control circuits V2 only in the third peripheral areas z3, which can not only release space of the spacing area B effectively to avoid arranging too many signal lines in the upper border area and to facilitate implementation of a narrow bezel design.

Figure 14:
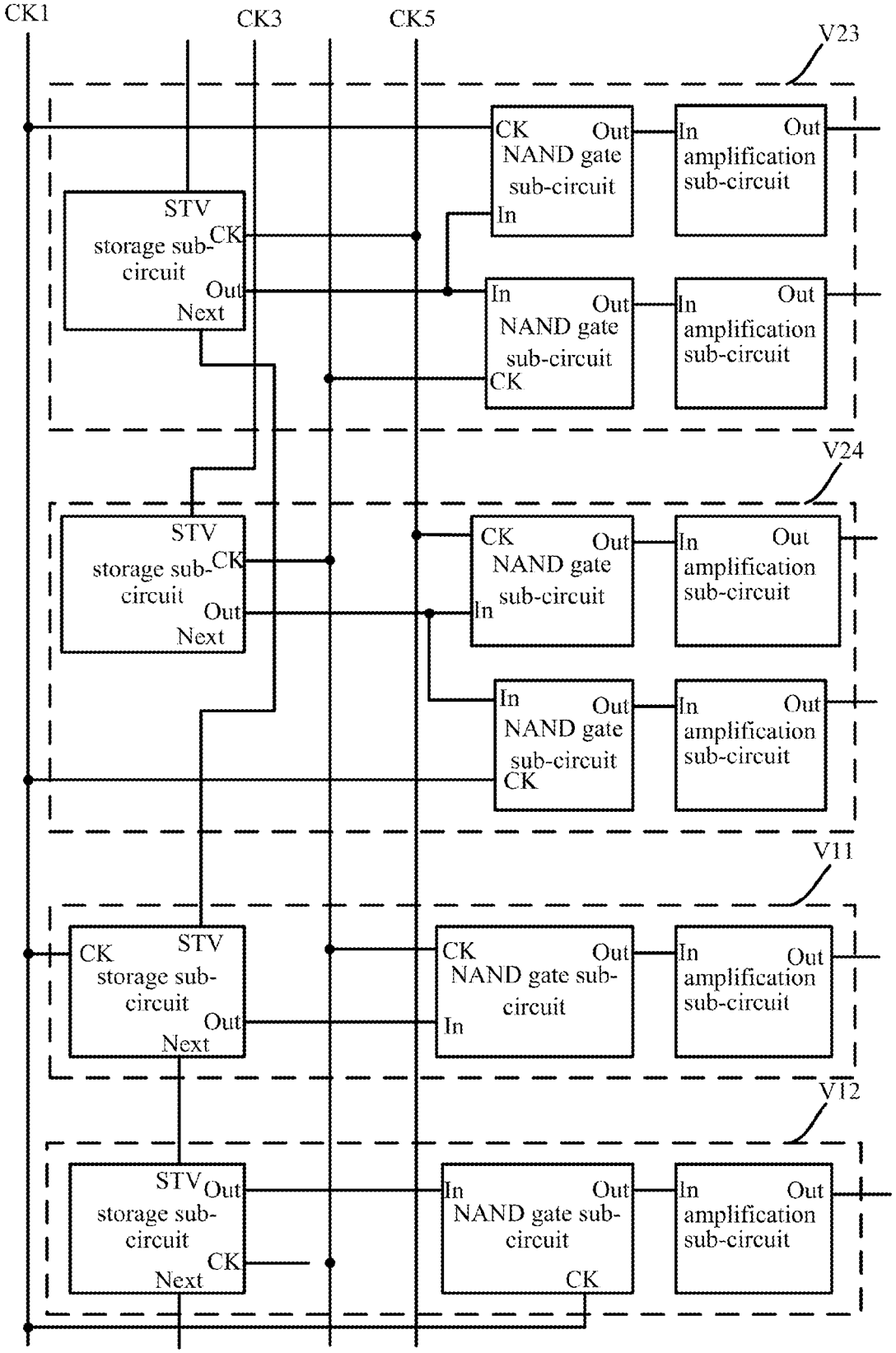
FIG. 14 is a circuit block diagram according to an embodiment of the disclosure.

Furthermore, for the sixth implementation mode, as illustrated by FIG. 14, a first scan control circuit (such as V11 or V12) can include one storage sub-circuit, one NAND gate sub-circuit and one amplification sub-circuit which are connected in series; and a second scan control circuit (such as V23 or V24) can include one storage sub-circuit, two NAND gate sub-circuits connected to the storage sub-circuit, and two amplification sub-circuits connected to the two NAND gate sub-circuits, respectively.

Each amplification sub-circuit of the first scan control circuit is electrically connected to a corresponding first scan signal line.

The two amplification sub-circuits of the second scan control circuit are electrically connected to two corresponding second scan signal lines, respectively.

In an embodiment, for two adjacent first scan control circuits, the storage sub-circuit of one first scan control circuit is electrically connected to the first clock signal line in the first group of clock signal lines, and the NAND gate sub-circuit of one first scan control circuit is electrically connected to the third clock signal line in the first group of clock signal lines; the storage sub-circuit of the other first scan control circuit is electrically connected to the third clock signal line in the first group of clock signal lines, and the NAND gate sub-circuit of the other first scan control circuit is electrically connected to the first clock signal line in the first group of clock signal lines.

In an embodiment, as illustrated by FIG. 14, on one side of the display area, a storage sub-circuit of a first one of three adjacent second scan control circuits is electrically connected to the fifth clock signal line in the first group of clock signal lines, one NAND gate sub-circuit of the first one of the three adjacent second scan control circuits is electrically connected to the first clock signal line in the first group of clock signal lines, and the other NAND gate sub-circuit of the first one of the three adjacent second scan control circuits is electrically connected to the third clock signal line in the first group of clock signal lines; a storage sub-circuit of a second one of the three adjacent second scan control circuits is electrically connected to the third clock signal line in the first group of clock signal lines, one NAND gate sub-circuit of the second one of the three adjacent second scan control circuits is electrically connected to the fifth clock signal line in the first group of clock signal lines, and the other NAND gate sub-circuit of the second one of the three adjacent second scan control circuits is electrically connected to the first clock signal line in the first group of clock signal lines; a storage sub-circuit of a third one of the three adjacent second scan control circuits is electrically connected to the first clock signal line in the first group of clock signal lines, one NAND gate sub-circuit of the third one of the three adjacent second scan control circuits is electrically connected to the third clock signal line in the first group of clock signal lines, and the other NAND gate sub-circuit of the third one of the three adjacent second scan control circuits is electrically connected to the fifth clock signal line in the first group of clock signal lines.

On the other side of the display area, a storage sub-circuit of a first one of three adjacent second scan control circuits is electrically connected to the sixth clock signal line in the second group of clock signal lines, one NAND gate sub-circuit of the first one of the three adjacent second scan control circuits is electrically connected to the second clock signal line in the second group of clock signal lines, and the other NAND gate sub-circuit of the first one of the three adjacent second scan control circuits is electrically connected to the fourth clock signal line in the second group of clock signal lines; a storage sub-circuit of a second one of the three adjacent second scan control circuits is electrically connected to the fourth clock signal line in the second group of clock signal lines, one NAND gate sub-circuit of the second one of the three adjacent second scan control circuits is electrically connected to the sixth clock signal line in the second group of clock signal lines, and the other NAND gate sub-circuit of the second one of the three adjacent second scan control circuits is electrically connected to the second clock signal line in the second group of clock signal lines; a storage sub-circuit of a third one of the three adjacent second scan control circuits is electrically connected to the second clock signal line in the second group of clock signal lines, one NAND gate sub-circuit of the third one of the three adjacent second scan control circuits is electrically connected to the fourth clock signal line in the second group of clock signal lines, and the other NAND gate sub-circuit of the third one of the three adjacent second scan control circuits is electrically connected to the sixth clock signal line in the second group of clock signal lines.

Of course, the structures of the storage sub-circuits, NAND gate sub-circuits and amplification sub-circuits included in the first scan control circuits or in the second scan control circuits can be any structures well-known by those skilled in the art.

It is noteworthy that, for the implementation mode illustrated by FIG. 13, when the first group of clock signal lines includes the first, third and fifth clock signal lines, and the second group of clock signal lines includes the second, fourth and sixth clock signal lines, the second scan signal lines at each stage in the two second display areas can be scanned simultaneously without changing the structure of the display panel but only by changing a time sequence of the clock signals. In such an implementation mode, the time sequence of the clock signals can be the time sequence of the inputs of the second scan control circuits, that is, the first and second clock signal lines input the first clock signals simultaneously, the third and fourth clock signal lines input the second clock signals simultaneously, the fifth and sixth clock signal lines input the third clock signals simultaneously, and the first, second and third clock signals are input successively. Or the time sequence of the clock signals can be the time sequence of the inputs of the first scan control circuits, that is, the first to sixth clock signal lines input the clock signals successively. Furthermore, the structure of the display panel in such an implementation mode is the same as the structure of the display panel in the implementation mode illustrated by FIG. 13, so the specific structure of the display panel can be referred to the sixth implementation mode, and a repeated description thereof is omitted here.

Figure 15:
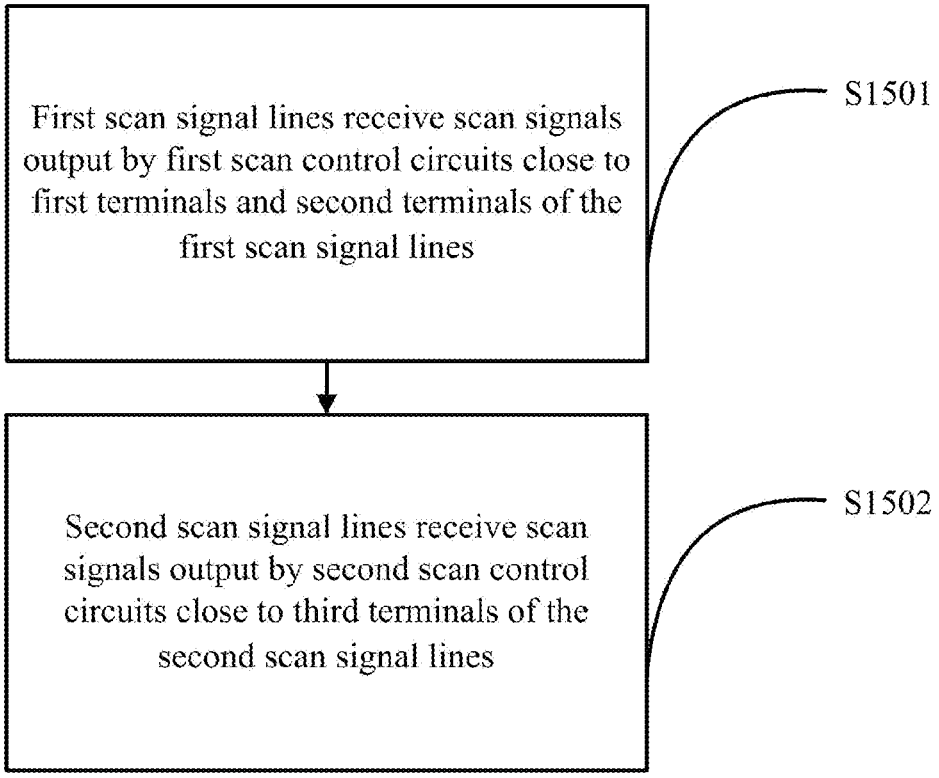
FIG. 15 is a flow chart of a method according to an embodiment of the disclosure.

Based upon the same inventive concept, an embodiment of the disclosure further provides a method for driving any one of the above-mentioned display panels. As illustrated by FIG. 15, the method can include the following operations S1501 and S1502.

S1501: first scan signal lines receive scan signals output by first scan control circuits close to first terminals and second terminals of the first scan signal lines.

S1502: second scan signal lines receive scan signals output by second scan control circuits close to third terminals of the second scan signal lines.

In an embodiment of the disclosure, when one second scan signal line is electrically connected to one second scan control circuit correspondingly, each of a first group of clock signal lines 10 and a second group of clock signal lines 20 can include a first clock signal line CK1 to a fourth clock signal line CK4. The clock signal lines input clock signals successively, that is, the first clock signal line CK1 to the fourth clock signal line CK4 input the clock signals successively, as illustrated by FIGS. 16 and 17.

Figure 16:
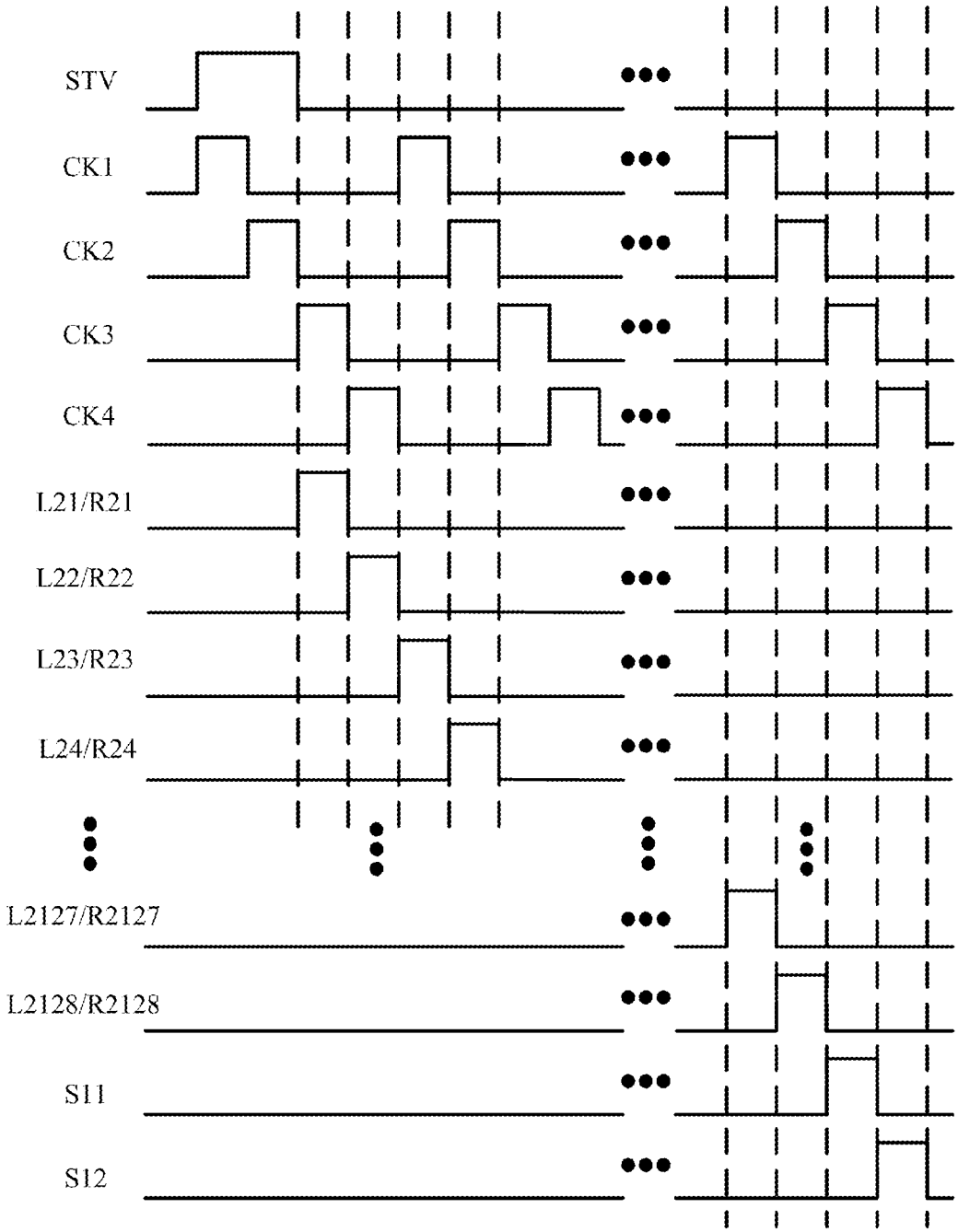
FIGS. 16-22 show time sequence diagrams according to embodiments of the disclosure.
Figure 17:
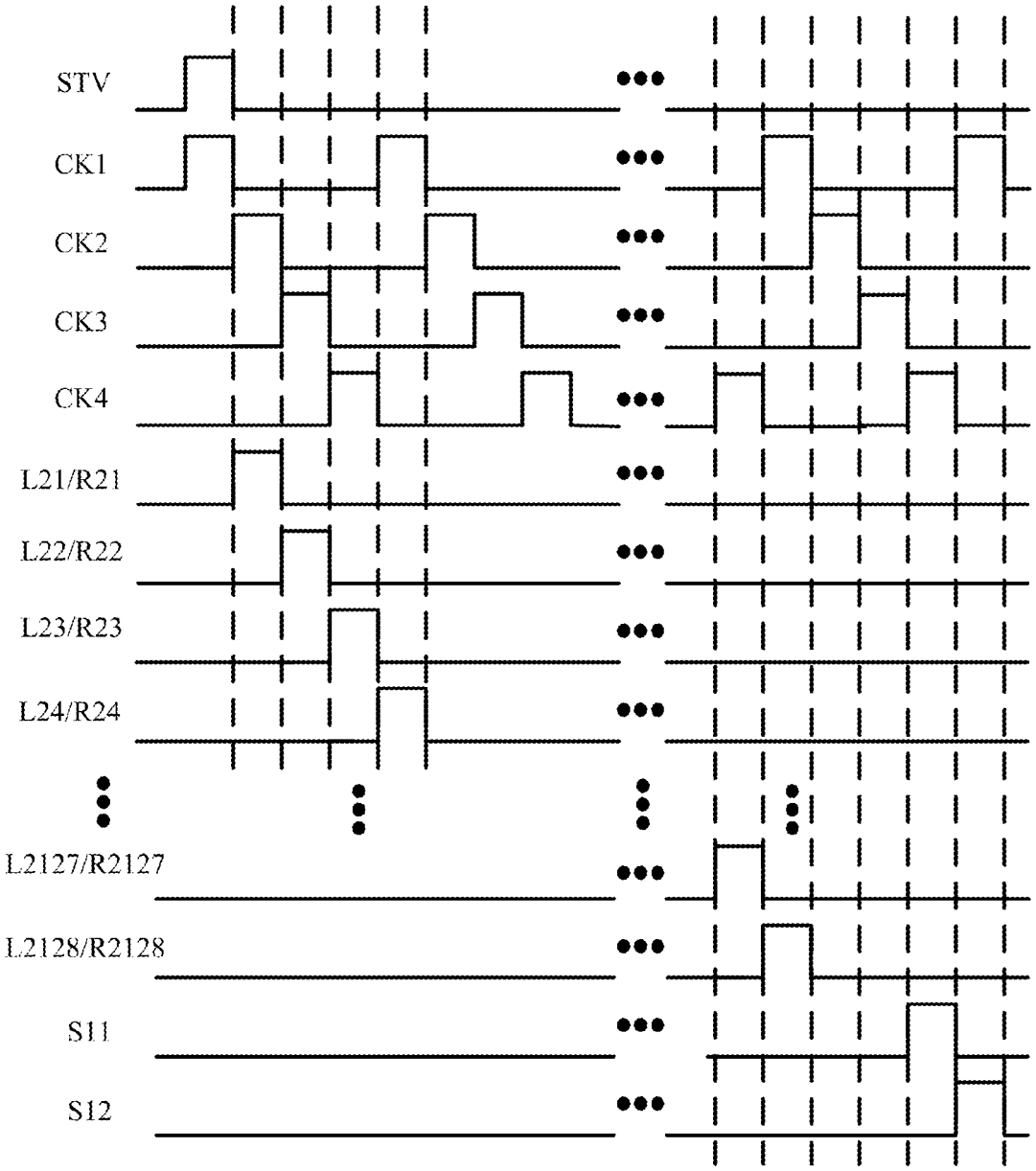

In an embodiment, as illustrated by FIG. 16, a pulse width of a start signal input by a start signal line to an STV is twice a pulse width of the clock signals, so as to implement the implementation mode illustrated by FIGS. 4-5. Whereas in another time sequence diagram illustrated by FIG. 17, the pulse width of the start signal input by the start signal line to an STV is equal to the pulse width of the clock signals, so as to implement the implementation mode illustrated by FIG. 7.

For example, 128 second scan signal lines are arranged in each of the areas A21 and A22. L21 to L24 represent four second scan signal lines from top to bottom in the area A21, R21 to R24 represent four second scan signal lines from top to bottom in the area A22, L127 and L128 represent the last two second scan signal lines in the area A21, R127 and R128 represent the last two second scan signal lines in the area A22, and S11 and S12 represent two first scan signal lines from top to bottom in the area A1. Through the time sequences illustrated by FIGS. 16 and 17, the second scan signal lines at each stage in the areas A21 and A22 can be scanned synchronously. Of course, the number of the second scan signal lines arranged in the areas A21 and A22 is not limited to 128. Here it is just an example.

In an embodiment, in order to implement the implementation mode illustrated by FIGS. 4-5 according to the time sequence diagram illustrated by FIG. 16, when a peripheral area further include start signal lines located at two opposite sides of a display area, the method can further include the following operations: inputting, by the start signal lines, start signals to signal input terminals of second scan control circuits at a first stage and signal input terminals of second scan control circuits at a second stage, respectively; transmitting, by second scan control circuits at each stage, scan signals output by their first signal output terminals to electrically connected second scan signal lines; and transmitting, by first scan control circuits at each stage, scan signals output by their first signal output terminals to electrically connected first scan signal lines; except second scan control circuits at last two stages, transmitting, by each second scan control circuit at each odd stage, an effective pulse signal output by its second signal output terminal to a signal input terminal of a second scan control circuit at a next odd stage, and transmitting, by each second scan control circuit at each even stage, an effective pulse signal output by its second signal output terminal to a signal input terminal of a second scan control circuit at a next even stage; and except first scan control circuits at a last stage, transmitting, by first scan control circuits at each stage, effective pulse signals output by their second signal output terminals to signal input terminals of first scan control circuits at a next stage; on one side of the display area, transmitting, by a second scan control circuit at a last odd stage, an effective pulse signals output by its second signal output terminals to a signal input terminal of a first scan control circuits at a first stage; and on the other side of the display area, transmitting, by a second scan control circuit at a last even stage, an effective pulse signal output by its second signal output terminal to a signal input terminal of a first scan control circuit at the first stage; or, on one side of the display area, transmitting, by a second scan control circuit at a last stage, an effective pulse signal output by its second signal output terminal to the signal input terminal of the first scan control circuit at the first stage; and on the other side of the display area, transmitting, by a second scan control circuit at the last stage, an effective pulse signal output by its second signal output terminal to the signal input terminal of the first scan control circuit at the first stage.

In an embodiment, in order to implement the implementation mode illustrated by FIG. 7 according to the time sequence diagram illustrated by FIG. 17, when the peripheral area further include the start signal lines located at two opposite sides of the display area, the method can further include the following operations: inputting, by the start signal lines, the start signals to the signal input terminals of the second scan control circuits at the first stage; transmitting, by the second scan control circuits at each stage, effective pulse signals output by their signal output terminals to electrically connected second scan signal lines; and transmitting, by the first scan control circuits at each stage, effective pulse signals output by their signal output terminals to electrically connected first scan signal lines; except the second scan control circuits at the last stage, transmitting, by the second scan control circuits at each stage, effective pulse signals output by their second signal output terminals to signal input terminals of second scan control circuits at a next stage; and except the first scan control circuits at the last stage, transmitting, by the first scan control circuits at each stage, effective pulse signals output by their signal output terminals to signal input terminals of first scan control circuits at a next stage; on one side of the display area, transmitting, by a second scan control circuits at the last stage, an effective pulse signal output by its signal output terminals to a signal input terminal of a first scan control circuit at the first stage; and on the other side of the display area, transmitting, by a second scan control circuit at a second last stage, an effective pulse signal output by its signal output terminal to a signal input terminal of a first scan control circuit at the first stage; or, on one side of the display area, transmitting, by a second scan control circuit at the last stage, an effective pulse signal output by its signal output terminal to a signal input terminal of a first scan control circuit at the first stage; and on the other side of the display area, transmitting, by a second scan control circuit at the last stage, an effective pulse signal output by its signal output terminal to a signal input terminal of a first scan control circuit at the first stage.

Of course, when one second scan signal line is electrically connected to one second scan control circuit correspondingly, the first group of clock signal lines 10 can include a first clock signal line CK1 and a third clock signal line CK3, the second group of clock signal lines 20 can include a second clock signal line CK2 and a fourth clock signal line CK4. Moreover, the four clock signal lines can have two types of time sequences as follows.

Figure 18:
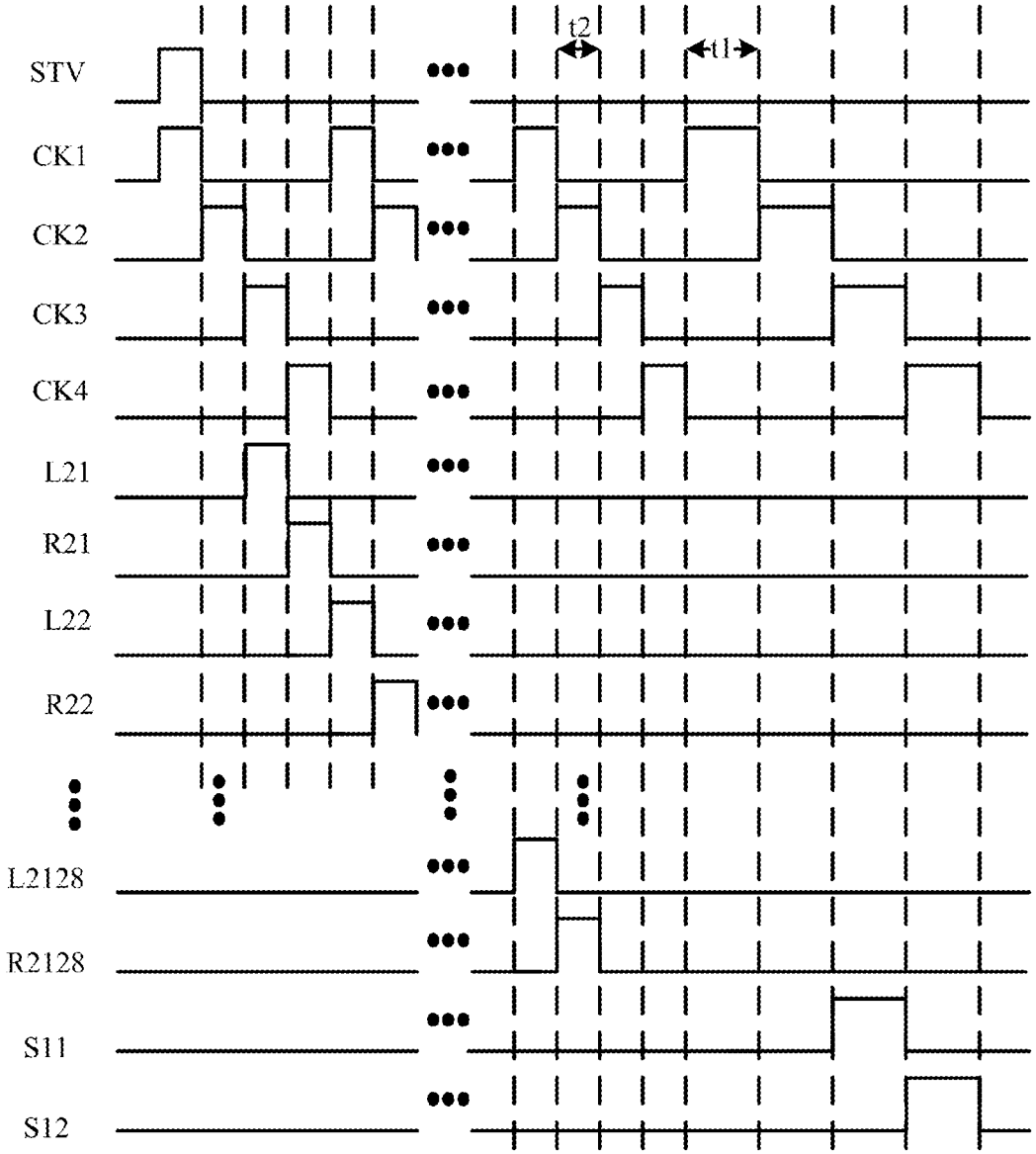

One type of time sequence is illustrated by FIG. 18. The first clock signal line CK1 to the fourth clock signal line CK4 input clock signals successively. The pulse width t1 of the clock signals input by the first and second groups of clock signal lines to the first scan control circuits is greater than the pulse width t2 of the clock signals input by the first and second groups of clock signal lines to the second scan control circuits, so as to implement the implementation mode illustrated by FIG. 11. It is noteworthy that a ratio of the two pulse widths (i.e., t1 and t2) is not limited to the ratio of the two pulse widths illustrated by FIG. 18. FIG. 18 is just intended for a clear illustration that the pulse width t2 and the pulse width t1 are different, and the ratio of t1 and t2 depends on specific circumstances in a specific implementation.

Figure 19:
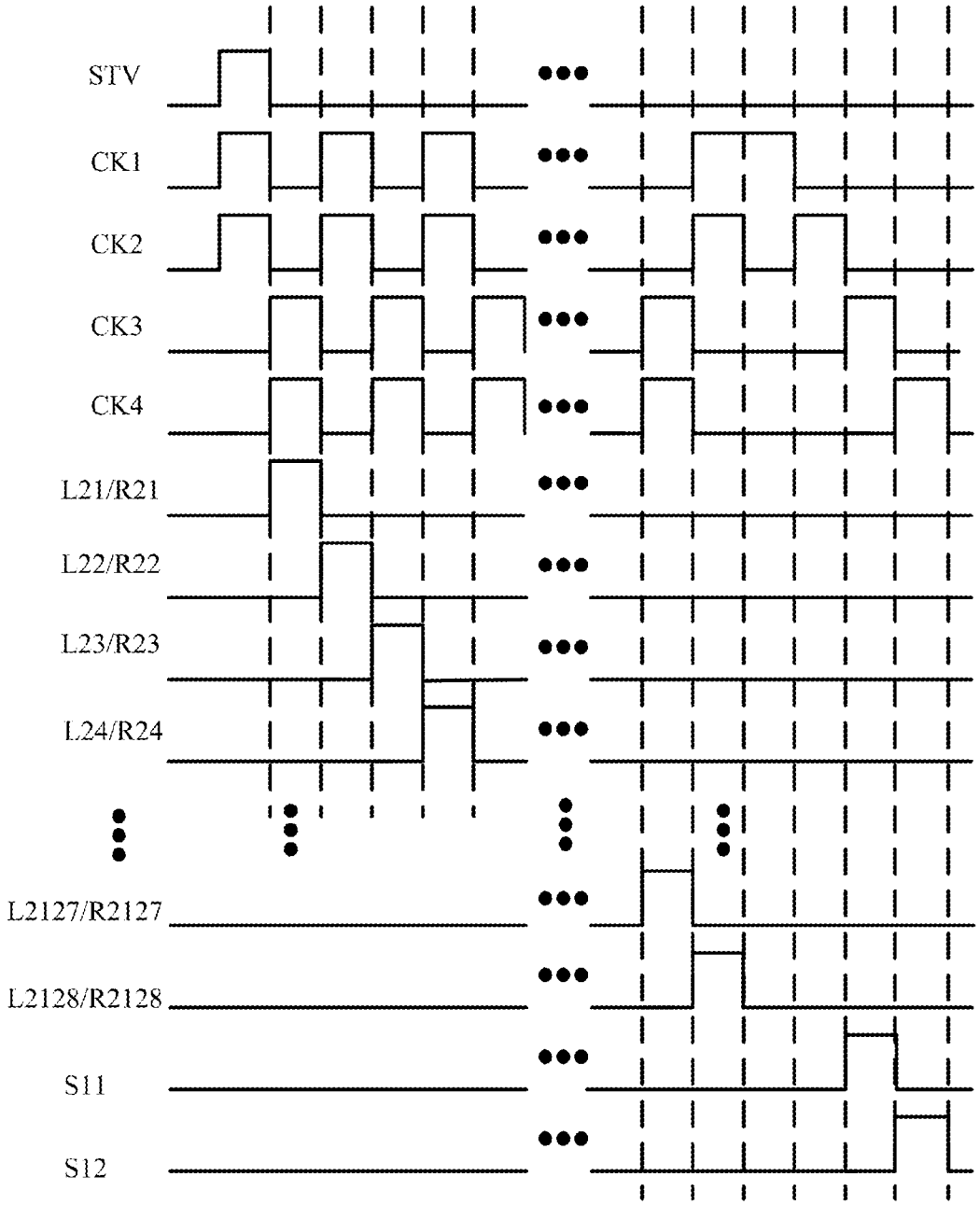

Another type of time sequence is illustrated by FIG. 19. The time sequence of the clock signals input by the first and second groups of clock signal lines to the first scan control circuits can be that the first to fourth clock signal lines input clock signals successively. The time sequence of the clock signals input by the first and second groups of clock signal lines to the second scan control circuits can be that the first and second clock signal lines CK1 and CK2 input first clock signals synchronously, the third and fourth clock signal lines CK3 and CK4 input second clock signals synchronously, and the first and second clock signals are input successively, so as to implement the implementation mode illustrated by FIG. 10.

For example, 128 second scan signal lines are arranged in each of the areas A21 and A22. L21 to L24 represent four second scan signal lines from top to bottom in the area A21. R21 to R24 represent four second scan signal lines from top to bottom in the area A22. L127 and L128 represent the last two second scan signal lines in the area A21. R127 and R128 represent the last two second scan signal lines in the area A22. S11 and S12 represent two first scan signal lines from top to bottom in the area A1. Through the time sequences illustrated by FIG. 19, the second scan signal lines at each stage in the areas A21 and A22 can be scanned synchronously. Of course, the number of the second scan signal lines arranged in the areas A21 and A22 is not limited to 128. Here it is just an example.

In an embodiment, in order to implement the implementation modes illustrated by FIGS. 10-11 according to the time sequence diagrams illustrated by FIGS. 18 and 19, when the peripheral area further include start signal lines located at two opposite sides of a display area, the method can further include the following operations: inputting, by the start signal lines, the start signals to the signal input terminals of the second scan control circuits at the first stage;

transmitting, by the second scan control circuits at each stage, scan signals output by their first signal output terminals to electrically connected second scan signal lines; and transmitting, by the first scan control circuits at each stage, scan signals output by their first signal output terminals to electrically connected first scan signal lines; except the second scan control circuits at the last stage, transmitting, by the second scan control circuits at each stage, effective pulse signals output by their second signal output terminals to signal input terminals of second scan control circuits at a next stage; and except the first scan control circuits at the last stage, transmitting, by the first scan control circuits at each stage, effective pulse signals output by their second signal output terminals to signal input terminals of first scan control circuits at a next stage; on one side of the display area, transmitting, by a second scan control circuit at the last stage, an effective pulse signal output by its second signal output terminal to a signal input terminal of a first scan control circuit at the first stage; and on the other side of the display area, transmitting, by a second scan control circuit at the second last stage, an effective pulse signals output by its second signal output terminal to a signal input terminal of a first scan control circuit at the first stage; or, on one side of the display area, transmitting, by a second scan control circuit at the last stage, an effective pulse signal output by its second signal output terminal to a signal input terminal of a first scan control circuit at the first stage; and on the other side of the display area, transmitting, by a second scan control circuit at the last stage, an effective pulse signal output by its second signal output terminal to a signal input terminal of a first scan control circuit at the first stage.

In an embodiment, when one second scan signal line is electrically connected to two second scan control circuit correspondingly, the clock signal lines can have three types of time sequences as follows.

Figure 20:
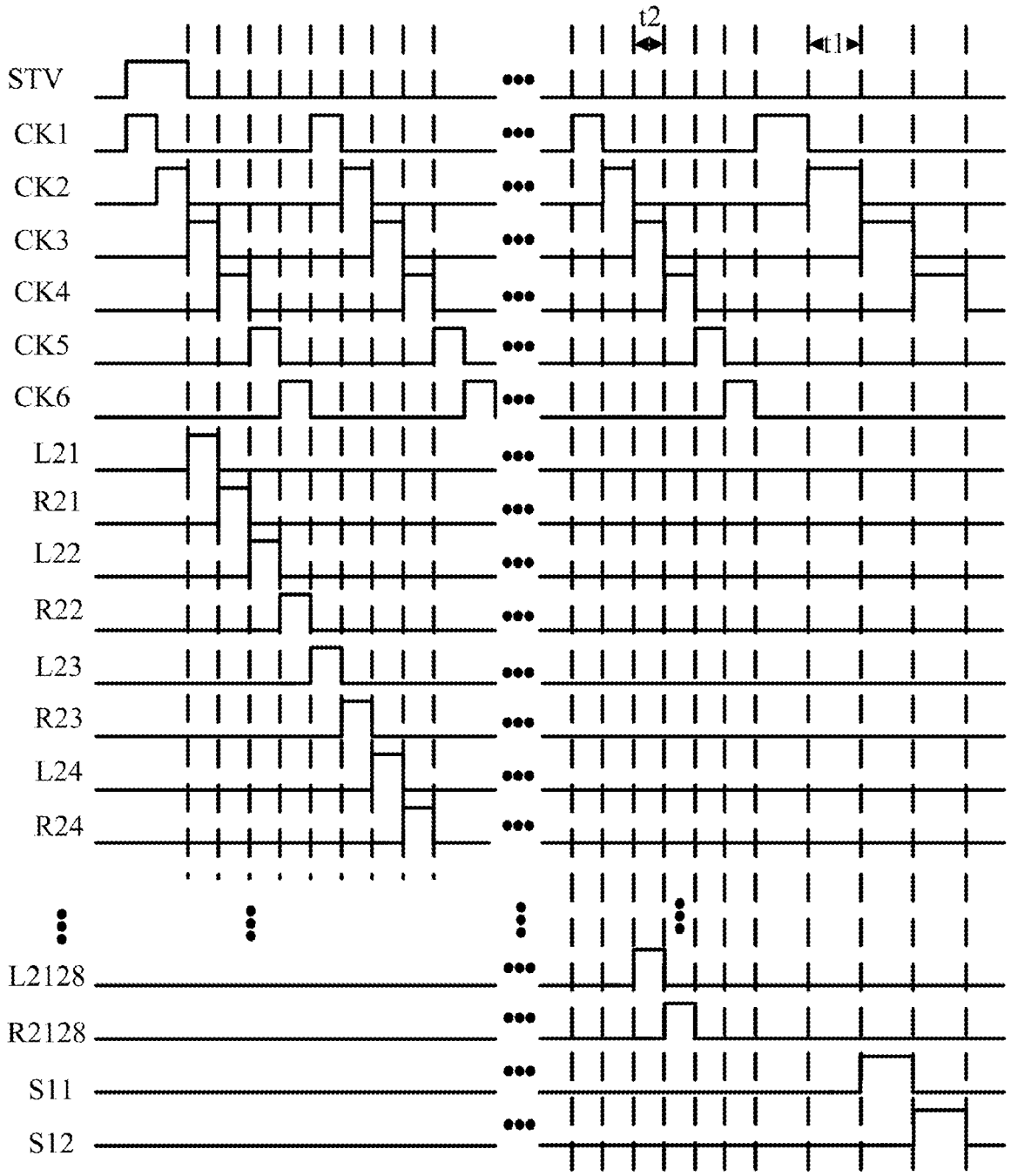

One type of time sequence is illustrated by FIG. 20. When one second scan signal line is electrically connected to two second scan control circuit correspondingly, the first group of clock signal lines can include a first clock signal line CK1, a third clock signal line CK3 and a fifth clock signal line CK5, the second group of clock signal lines can include a second clock signal line CK2, a fourth clock signal line CK4 and a sixth clock signal line CK6. The first clock signal line CK1 to the sixth clock signal line CK6 input clock signals successively. The pulse width t1 of the clock signals input by the first and second groups of clock signal lines to the first scan control circuits is greater than the pulse width t2 of the clock signals input by the first and second groups of clock signal lines to the second scan control circuits, so as to implement the implementation mode illustrated by FIG. 13. It is noteworthy that a ratio of the two pulse widths (i.e., t1 and t2) is not limited to the ratio of the two pulse widths illustrated by FIG. 20. FIG. 20 is just intended for a clear illustration that the pulse width t2 and the pulse width t1 are different, and the ratio of t1 and t2 depends on specific circumstances in a specific implementation.

Figure 21:
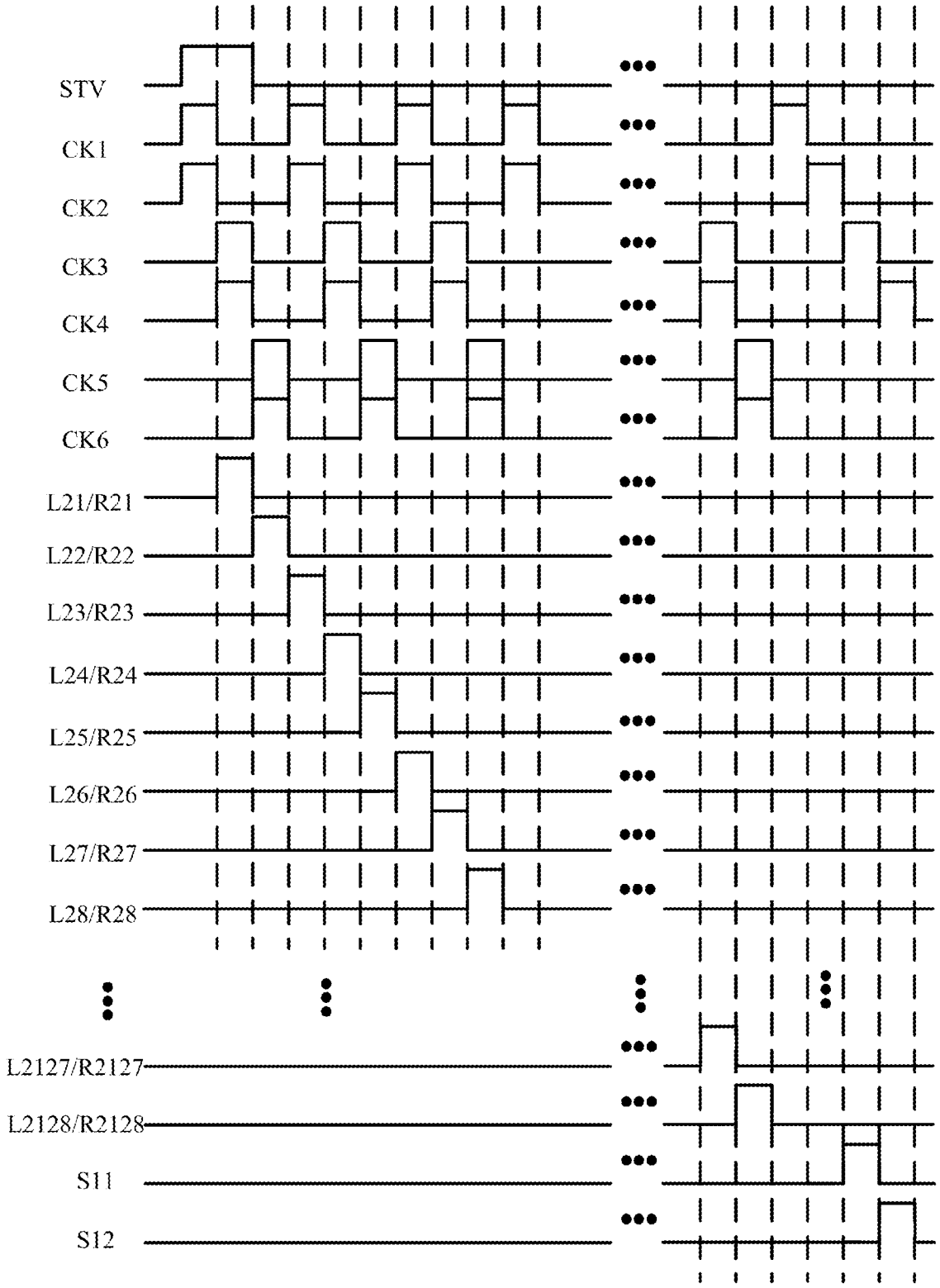

Another type of time sequence is illustrated by FIG. 21. When one second scan signal line is electrically connected to two second scan control circuit correspondingly, the first group of clock signal lines can include a first clock signal line CK1, a third clock signal line CK3 and a fifth clock signal line CK5, the second group of clock signal lines can include a second clock signal line CK2, a fourth clock signal line CK4 and a sixth clock signal line CK6. The time sequence of the clock signals input by the first and second groups of clock signal lines to the second scan control circuits can be that the first clock signal line CK1 and the second clock signal line CK2 input the first clock signals simultaneously, the third clock signal line CK3 and the fourth clock signal line CK4 input the second clock signals simultaneously, the fifth clock signal line CK5 and the sixth clock signal line CK6 input the third clock signals simultaneously, and the first, second and third clock signals are input successively. The time sequence of the clock signals input by the first and second groups of clock signal lines to the first scan control circuits can be that the first clock signal line CK1 to the sixth clock signal line CK6 input the clock signals successively, so as to implement the last implementation mode.

Figure 22:
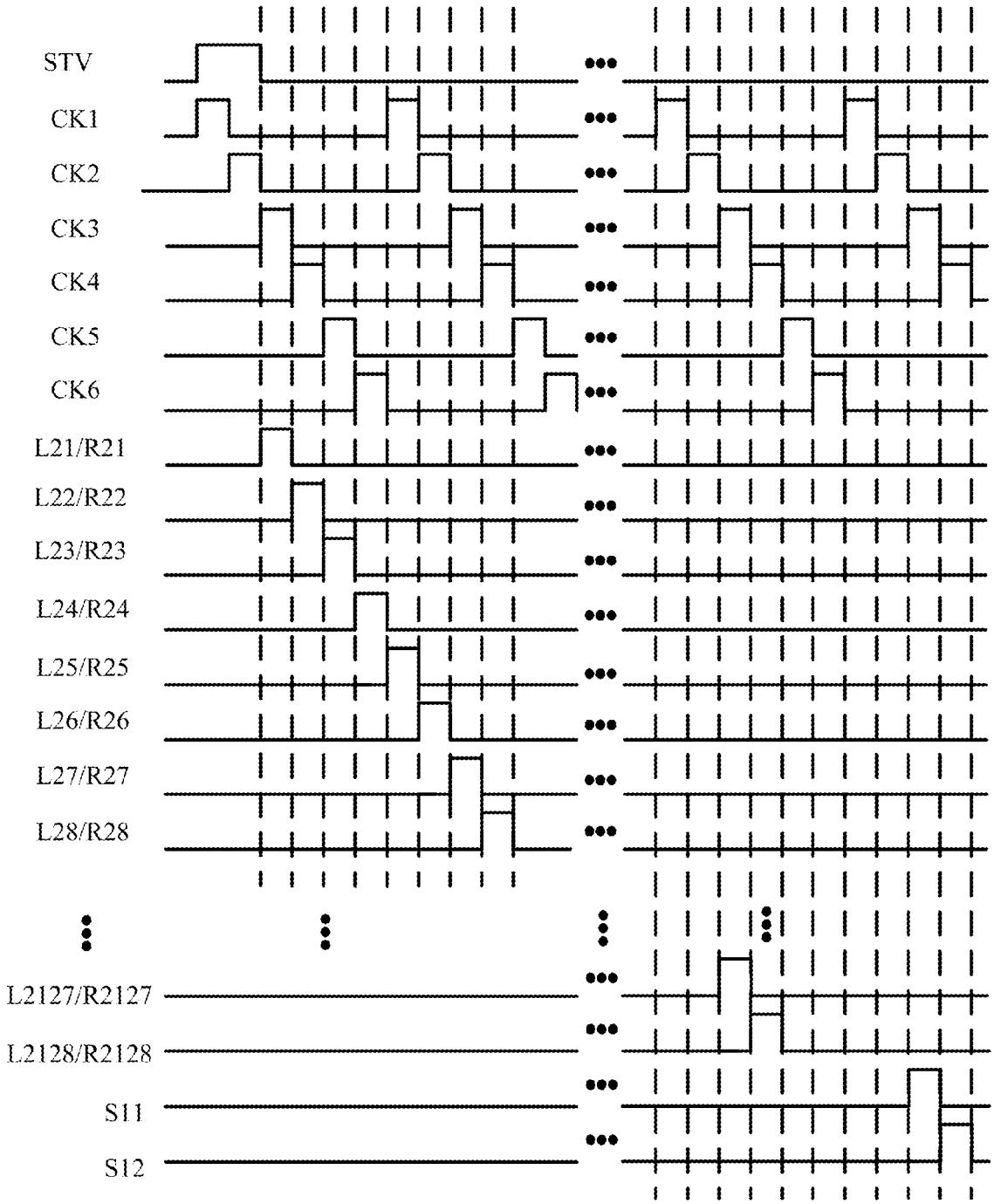

Still another type of time sequence is illustrated by FIG. 22. When one second scan signal line is electrically connected to two second scan control circuits separated by one second scan control circuit correspondingly, each of the first and second groups of clock signal lines can include a first clock signal line CK1 to a sixth clock signal line CK6. All the clock signal lines input the clock signals successively, that is, the first clock signal line CK1 to the sixth clock signal line CK6 input the clock signals successively, so as to implement the implementation mode illustrated by FIG. 8.

For example, 128 second scan signal lines are arranged in each of the areas A21 and A22. L21 to L28 represent eight second scan signal lines from top to bottom in the area A21. R21 to R28 represent eight second scan signal lines from top to bottom in the area A22. L127 and L128 represent the last two second scan signal lines in the area A21. R127 and R128 represent the last two second scan signal lines in the area A22. S11 and S14 represent four first scan signal lines from top to bottom in the area A1. Through the time sequences illustrated by FIG. 2, the second scan signal lines at each stage in the areas A21 and A22 can be scanned synchronously. Of course, the number of the second scan signal lines arranged in the areas A21 and A22 is not limited to 128. Here it is just an example.

In an embodiment, in order to implement the implementation modes illustrated by FIGS. 8 and 13 and the last implementation mode, when the peripheral area further include start signal lines located at two opposite sides of a display area, the method can further include the following operations: inputting, by the start signal lines, the start signals to the signal input terminals of the second scan control circuits at the first stage and the signal input terminals of the second scan control circuits at the second stage, respectively; transmitting, by the second scan control circuits at each stage a scan signals output by their first signal output terminals to electrically connected second scan signal lines; and transmitting, by the first scan control circuits at each stage, scan signals output by their first signal output terminals to electrically connected first scan signal lines; except the second scan control circuits at the last two stages, transmitting, by the second scan control circuits at each odd stage, effective pulse signals output by their second signal output terminals to signal input terminals of second scan control circuits at a next odd stage, and transmitting, by the second scan control circuits at each even stage, effective pulse signals output by their second signal output terminals to signal input terminals of second scan control circuits at a next even stage; and except the first scan control circuits at the last stage, transmitting, by the first scan control circuits at each stage, effective pulse signals output by their second signal output terminals to signal input terminals of first scan control circuit at a next stage; on one side of the display area, transmitting, by a second scan control circuit at the last odd stage, an effective pulse signal output by its second signal output terminal to a signal input terminal of a first scan control circuit at the first stage; and on the other side of the display area, transmitting, by a second scan control circuit at the last even stage, an effective pulse signal output by its second signal output terminal to a signal input terminal of a first scan control circuit at the first stage; or on one side of the display area, transmitting, by a second scan control circuit at the last stage, an effective pulse signal output by its second signal output terminal to a signal input terminal of a first scan control circuit at the first stage; and on the other side of the display area, transmitting, by a second scan control circuit at the last stage, an effective pulse signal output by its second signal output terminal to a signal input terminal of a first scan control circuit at the first stage.

Figure 23:
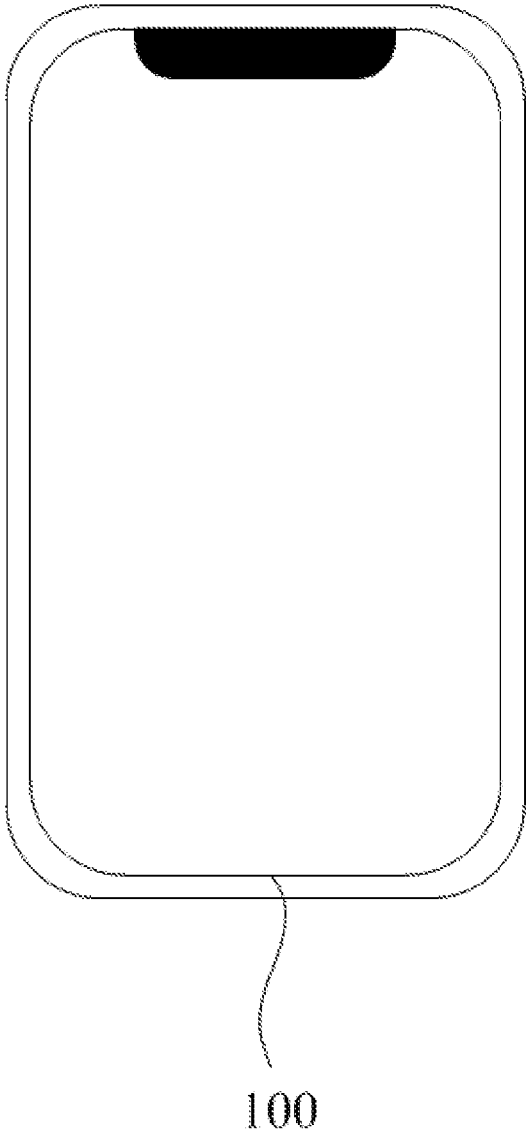
FIG. 23 is a structural schematic diagram of a display device according to an embodiment of the disclosure.

Based upon the same inventive concept, an embodiment of the disclosure further provides a display device. As illustrated by FIG. 23, the display device can include any one of the above-mentioned display panels 100. The display device can be any product or component with display functions such as a mobile phone (as illustrated by FIG. 23), a tablet, a television, a display, a laptop, a digital photo frame, or a navigator. The implementations of this display device can be referred to the embodiments of the above-mentioned display panels, and a repeated description thereof is omitted here.

The embodiments of the disclosure provide a display panel, a method for driving the display panel and a display device. The peripheral area of the display panel includes cascaded first scan control circuits close to first and second terminals of the first scan signal lines, respectively, and cascaded second scan control circuits close to third terminals of the second scan signal lines. The first scan signal lines are electrically connected to the first scan control circuits close to the first terminals and the second terminals alternately. The second scan signal lines are electrically connected to the cascaded second scan control circuits. In this way, a complex circuit structure and complex wiring can be avoided effectively, and the space of the peripheral area on one side of the second display area farthest away from the first display area can be released effectively, increasing area of the display area in the arrangement direction of the first display area and the at least one second display area, increasing the screen-to-body ratio and promoting user experience.

Evidently those skilled in the art can make various modifications and variations to the disclosure without departing from the spirit and scope of the disclosure. Thus the disclosure also encompasses these modifications and variations therein as long as these modifications and variations come into the scope of the claims of the disclosure and their equivalents.

What is claimed is:

1. A display panel, comprising:

a display area and a peripheral area surrounding the display area;

wherein the display area comprises one first display area and two second display areas;

wherein the first display area comprises at least two first scan signal lines arranged along a first direction, wherein each of the at least two first scan signal lines has a first terminal and a second terminal in the first direction;

wherein each of the at least one second display area comprises at least two second scan signal lines arranged along the first direction, wherein each of the at least two second scan signal lines has a third terminal close to the peripheral area in the first direction; wherein the first display area and the second display area are arranged along the first direction; wherein two second signal lines farthest away from the first display area in the two second display areas are electrically connected; wherein at least one second signal line located in one of the two second display areas and at least one second signal line located in other one of the two second display areas are disconnected to each other;

wherein the peripheral area comprises a spacing area, a first peripheral area, a second peripheral area, and at least two third peripheral areas;

wherein the peripheral area comprises a plurality of cascaded first scan control circuits close to the first and second terminals of the at least two first scan signal lines, and a plurality of cascaded second scan control circuits close to the third terminals of the at least two second scan signal lines;

wherein each of the at least two first scan signal lines is electrically connected to one of the plurality of cascaded first scan control circuits close to the first and second terminals alternately;

wherein each of the at least two second scan signal lines is electrically connected to one of the plurality of cascaded second scan control circuits;

wherein a first group of clock signal lines is arranged in the first peripheral area and one of the at least two third peripheral areas, and a second group of clock signal lines is arranged in the second peripheral area and another one of the at least two third peripheral areas;

wherein the first group of clock signal lines is respectively electrically connected to the plurality of cascaded first scan control circuits and the plurality of cascaded second scan control circuits on one side of the display area; and wherein the second group of clock signal lines is respectively electrically connected to the plurality of cascaded first scan control circuits and the plurality of cascaded second scan control circuits located on another side of the display area.

2. The display panel according to claim 1, wherein each of the plurality of cascaded first scan control circuits and each of the plurality of cascaded second scan control circuits share a same structure;

wherein the spacing area and the two second display areas are arranged on a same side of the first display area, and the spacing area is between the two second display areas;

wherein the first and second peripheral areas are on two opposite sides of the first display area, respectively;

wherein each of the at least two third peripheral areas is on one same side of each of the two second display areas farthest away from the spacing area;

wherein one of the at least two third peripheral areas and the first peripheral area are on one side of the display area, and another one of the at least two third peripheral areas and the second peripheral area are on another side of the display area;

wherein the plurality of cascaded first scan control circuits are in the first and second peripheral areas, and the plurality of cascaded second scan control circuits are in the at least two third peripheral areas.

3. The display panel according to claim 1, wherein in each second display area, two of the at least two second scan signal lines separated by another second scan signal line are electrically connected to one of the plurality of cascaded second scan control circuits; and wherein each of the first and second groups of clock signal lines comprises six clock signal lines.

4. The display panel according to claim 3, wherein on one side of the display area, each of the plurality of cascaded first scan control circuits is electrically connected to a first clock signal line and a third clock signal line in the first group of clock signal lines, respectively; wherein one of two adjacent second scan control circuits is electrically connected to the first clock signal line, the third clock signal line and a fifth clock signal line in the first group of clock signal lines, and wherein the other one of the two adjacent second scan control circuits is electrically connected to a second clock signal line, wherein a fourth clock signal line and a sixth clock signal line in the first group of clock signal lines;

wherein on another side of the display area, each of the plurality of cascaded first scan control circuits is electrically connected to a second clock signal line and a fourth clock signal line in the second group of clock signal lines, respectively; wherein one of two adjacent second scan control circuits is electrically connected to a first clock signal line, a third clock signal line and a fifth clock signal line in the second group of clock signal lines, and the other one of the two adjacent second scan control circuits is electrically connected to the second clock signal line, wherein the fourth clock signal line and a sixth clock signal line in the second group of clock signal lines.

5. The display panel according to claim 1, wherein in each of the two second display areas, two adjacent second scan signal lines are electrically connected to one of the second scan control circuits;

wherein the first group of clock signal lines comprises a first clock signal line, a third clock signal line and a fifth clock signal line; and wherein the second group of clock signal lines comprises a second clock signal line, a fourth clock signal line and a sixth clock signal line.

6. The display panel according to claim 5, wherein on one side of the display area, each of the plurality of cascaded first scan control circuits is electrically connected to the first and third clock signal lines in the first group of clock signal lines, respectively; and each of the plurality of cascaded second scan control circuits is electrically connected to the first, third and fifth clock signal lines in the first group of clock signal lines, respectively;

wherein on another side of the display area, each of the plurality of cascaded first scan control circuits is electrically connected to the second and fourth clock signal lines in the second group of clock signal lines, respectively; and wherein each of the plurality of cascaded second scan control circuits is electrically connected to the second, fourth and sixth clock signal lines in the second group of clock signal lines, respectively.

7. The display panel according to claim 1, wherein one of the at least two second scan signal lines is electrically connected to one of the second scan control circuits; and wherein each of the first and second groups of clock signal lines comprises four clock signal lines.

8. The display panel according to claim 7, wherein on one side of the display area, each of the plurality of cascaded first scan control circuits is electrically connected to a first clock signal line and a third clock signal line in the first group of clock signal lines, respectively; wherein one of two adjacent second scan control circuits is electrically connected to the first and third clock signal lines in the first group of clock signal lines, and another one of said two adjacent second scan control circuits is electrically connected to a second clock signal line and a fourth clock signal line in the first group of clock signal lines;

wherein on the other side of the display area, each of the plurality of cascaded first scan control circuits is electrically connected to a second clock signal line and a fourth clock signal line in the second group of clock signal lines, respectively; wherein one of two adjacent second scan control circuits is electrically connected to a first clock signal line and a third clock signal line in the second group of clock signal lines, and another one of said two adjacent second scan control circuits is electrically connected to the second and fourth clock signal lines in the second group of clock signal lines.

9. The display panel according to claim 7, wherein on one side of the display area, each of the plurality of cascaded first scan control circuits is electrically connected to a second clock signal line and a fourth clock signal line in the first group of clock signal lines, respectively;

wherein a second scan control circuit at a 4n+1 stage of the plurality of cascaded second scan control circuits is electrically connected to a first clock signal line and a second clock signal line in the first group of clock signal lines, respectively; wherein a second scan control circuit at a 4n+2 stage of the plurality of cascaded second scan control circuits is electrically connected to the second clock signal line and a third clock signal line in the first group of clock signal lines, respectively; wherein a second scan control circuit at a 4n+3 stage of the plurality of cascaded second scan control circuits is electrically connected to the third and fourth clock signal lines in the first group of clock signal lines, respectively; and wherein a second scan control circuit at a 4n+4 stage of the plurality of cascaded second scan control circuits is electrically connected to the fourth and first clock signal lines in the first group of clock signal lines respectively;

wherein on the other side of the display area, each of the plurality of cascaded first scan control circuits is electrically connected to a first clock signal line and a third clock signal line in the second group of clock signal lines, respectively; wherein a second scan control circuit at the 4n+1 stage of the plurality of cascaded second scan control circuits is electrically connected to the first clock signal line and a second clock signal line in the second group of clock signal lines, respectively; a second scan control circuit at the 4n+2 stage of the plurality of cascaded second scan control circuits is electrically connected to the second and third clock signal lines in the second group of clock signal lines, respectively; wherein the second scan control circuit at the 4n+3 stage of the plurality of cascaded second scan control circuits is electrically connected to the third clock signal line and a fourth clock signal line in the second group of clock signal lines respectively; and wherein a second scan control circuit at the 4n+4 stage of the plurality of cascaded second scan control circuits is electrically connected to the fourth and first clock signal lines in the second group of clock signal lines respectively; and wherein n is an integer not less than 1.

10. The display panel according to claim 1, wherein one of the at least two second scan signal lines is electrically connected to one of the plurality of cascaded second scan control circuits;

wherein the first group of clock signal lines comprises a first clock signal line and a third clock signal line;

wherein the second group of clock signal lines comprises a second clock signal line and a fourth clock signal line;

wherein on one side of the display area, each of the pluralities of cascaded first and second scan control circuits is electrically connected to a first clock signal line and a third clock signal line in the first group of clock signal lines;

wherein on another side of the display area, each of the pluralities of cascaded first and second scan control circuits are all electrically connected to a second clock signal line and a fourth clock signal line in the second group of clock signal lines.

11. A method for driving a display panel, wherein the display panel comprises a display area and a peripheral area surrounding the display area; the display area comprises one first display area and two second display areas;

wherein the peripheral area comprises a spacing area, a first peripheral area, a second peripheral area, and at least two third peripheral areas; wherein the first display area comprises at least two first scan signal lines arranged along a first direction; each of the at least two first scan signal lines has a first terminal and a second terminal in the first direction; each of the at least one second display area comprises at least two second scan signal lines arranged along the first direction; each of the at least two second scan signal lines has a third terminal close to the peripheral area in the first direction; the first display area and the second display area are arranged along the first direction;

wherein two second signal lines farthest away from the first display area in the two second display areas are electrically connected; wherein at least one second signal line located in one of the two second display areas and at least one second signal line located in other one of the two second display areas are disconnected to each other; wherein the peripheral area comprises a plurality of cascaded first scan control circuits close to the first and second terminals of the at least two first scan signal lines, and a plurality of cascaded second scan control circuits close to the third terminals of the at least two second scan signal lines; each of the at least two first scan signal lines is electrically connected to one of the plurality of cascaded first scan control circuits close to the first and second terminals alternately;

wherein each of the at least two second scan signal lines is electrically connected to one of the plurality of cascaded second scan control circuits;

wherein a first group of clock signal lines is arranged in the first peripheral area and one of the at least two third peripheral areas, and a second group of clock signal lines is arranged in the second peripheral area and another one of the at least two third peripheral areas; wherein the first group of clock signal lines are electrically connected to the plurality of cascaded first scan control circuits and the plurality of cascaded second scan control circuits on one side of the display area, respectively; and wherein the second group of clock signal lines are electrically connected to the plurality of cascaded first scan control circuits and the plurality of cascaded second scan control circuits located on another side of the display area, respectively;

wherein the method for driving the display panel comprises:

receiving, by the first scan signal lines, scan signals output at the first scan control circuits close to the first terminals and second terminals of the first scan signal lines, alternately; and receiving, by the second scan signal lines, scan signals output by the second scan control circuits close to the third terminals of the second scan signal lines.

12. The method according to claim 11, when the peripheral area has start signal lines on two opposite sides of the display area, the method further comprising:

inputting, by the start signal lines, start signals to a signal input terminal of a second scan control circuit at a first stage and to a signal input terminal of a second scan control circuit at a second stage, respectively;

transmitting, by a second scan control circuit at each stage, a scan signal output by a first signal output terminal of the second scan control circuit to an electrically connected second scan signal line;

transmitting, by a first scan control circuit at each stage, a scan signal output by a first signal output terminal of the first scan control circuit to an electrically connected first scan signal line;

transmitting, by a second scan control circuit at each odd stage, an effective pulse signal output by its second signal output terminal to a signal input terminal of a second scan control circuit at a next odd stage, except at last two stages of the second scan control circuits;

transmitting, by a second scan control circuit at each even stage, an effective pulse signal output by its second signal output terminal to a signal input terminal of a second scan control circuit at a next even stage; and transmitting, by a first scan control circuit at each stage, an effective pulse signal output by its second signal output terminal to a signal input terminal of a first scan control circuit at a next stage, except at a last stage of the first scan control circuits;

wherein on one side of the display area, transmitting, by a second scan control circuit at a last odd stage, an effective pulse signal output by its second signal output terminal to a signal input terminal of a first scan control circuit at a first stage, and wherein on the other side of the display area, transmitting, by a second scan control circuit at a last even stage, an effective pulse signal output by its second signal output terminal to a signal input terminal of a first scan control circuit at the first stage; or, transmitting, by a second scan control circuit at a last stage, an effective pulse signal output by its second signal output terminal to a signal input terminal of a first scan control circuit at the first stage.

13. The method according to claim 12, wherein each of the first group of clock signal lines and or each of the second group of clock signal lines comprises four or six clock signal lines, wherein the method further comprises:

inputting, by all the clock signal lines, clock signals successively.

14. The method according to claim 12, wherein the first group of clock signal lines comprises a first clock signal line, a third clock signal line and a fifth clock signal line; and the second group of clock signal lines comprises a second clock signal line, a fourth clock signal line and a sixth clock signal line, the method further comprising:

inputting, by the first to sixth clock signal lines, clock signals successively;

wherein a pulse width of the clock signals input by the first and second groups of clock signal lines to the first scan control circuits is greater than a pulse width of the clock signals input by the first and second groups of clock signal lines to the second scan control circuits.

15. The method according to claim 12, when the first group of clock signal lines comprises a first clock signal line, a third clock signal line and a fifth clock signal line, and the second group of clock signal lines comprises a second clock signal line, a fourth clock signal line and a sixth clock signal line, wherein the method further comprises:

forming a time sequence of clock signals input by the first and second groups of clock signal lines to the first scan control circuits, wherein the first to sixth clock signal lines input clock signals successively; and forming a time sequence of clock signals input by the first and second groups of clock signal lines to the second scan control circuits, wherein first clock signals input by the first and the second clock signal lines input are synchronized, second clock signals input by the third and fourth clock signal lines input are synchronized, wherein third clock signals input by the fifth and sixth clock signal lines input are synchronized, and the first, the second and the third clock signals are successive inputs.

16. The method according to claim 13, when the peripheral area has start signal lines on two opposite sides of the display area, the method further comprising:

inputting, by the start signal lines, start signals to a signal input terminal of a second scan control circuit at a first stage;

transmitting, by a second scan control circuit at each stage, an effective pulse signal output by its signal output terminal to an electrically connected second scan signal line;

transmitting, by a first scan control circuit at each stage, an effective pulse signal output by its signal output terminal to an electrically connected first scan signal line;

transmitting, by a second scan control circuit at every other stage, except at a last stage of the second scan control circuits, an effective pulse signal output by its signal output terminal to a signal input terminal of a second scan control circuit at a next stage; and transmitting, by a first scan control circuit at each stage, an effective pulse signal output by its signal output terminal to a signal input terminal of a first scan control circuit at a next stage, except at a last stage of the first scan control circuits;

wherein on one side of the display area, transmitting, by a second scan control circuit at the last stage, an effective pulse signal output by a signal output terminal of the second scan control circuit to a signal input terminal of a first scan control circuit at a first stage, and on the other side of the display area, transmitting, by a second scan control circuit at a second last stage, an effective pulse signal output by its signal output terminal to a signal input terminal of a first scan control circuit at the first stage; or, transmitting, by a second scan control circuit at the last stage, an effective pulse signal output by its second signal output terminal to a signal input terminal of a first scan control circuit at the first stage.

17. The method according to claim 11, when the peripheral area has start signal lines on two opposite sides of the display area, wherein the method further comprises:

inputting, by the start signal lines, start signals to signal input terminals of second scan control circuits at a first stage;

transmitting, by second scan control circuits at each stage, scan signals output by their first signal output terminals to electrically connected second scan signal lines;

transmitting, by first scan control circuits at each stage, scan signals output by their first signal output terminals to electrically connected first scan signal lines;

transmitting, by second scan control circuits at each stage, effective pulse signals output by their second signal output terminals to signal input terminals of second scan control circuit at a next stage, except at a last stage of the second scan control circuits; and transmitting, by first scan control circuits at each stage, effective pulse signals output by their second signal output terminals to signal input terminals of first scan control circuits at a next stage, except at a last stage of the first scan control circuits;

wherein on one side of the display area, transmitting, by a second scan control circuit at the last stage, an effective pulse signal output by its second signal output terminal to a signal input terminal of a first scan control circuit at a first stage, and on the other side of the display area, transmitting, by a second scan control circuit at a second last stage, an effective pulse signal output by its second signal output terminal to a signal input terminal of a first scan control circuit at the first stage; or transmitting, by the second scan control circuits at the last stage, effective pulse signals output by their second signal output terminals to signal input terminals of first scan control circuit at the first stage.

18. The method according to claim 17, wherein the method further comprises:

forming a time sequence of clock signals input by the first and second groups of clock signal lines to the first scan control circuits, wherein the first to fourth clock signal lines input clock signals successively; and forming a time sequence of clock signals input by the first and second groups of clock signal lines to the second scan control circuits, wherein first clock signals input by the first and the second clock signal lines are synchronized, second clock signals input by the third and fourth clock signal lines are synchronized, and the first and the second clock signals are successive inputs.

19. The method according to claim 17, when the first group of clock signal lines comprises a first clock signal line and a third clock signal line; and the second group of clock signal lines comprises a second clock signal line and a fourth clock signal line, wherein the method further comprises:

inputting, clock signals successively by the first to fourth clock signal lines;

wherein a pulse width of the clock signals input by the first and second groups of clock signal lines to the first scan control circuits is greater than a pulse width of the clock signals input by the first and second groups of clock signal lines to the second scan control circuits.

* * * * *